US011268241B2

(12) United States Patent
Hasegawa et al.

(10) Patent No.: US 11,268,241 B2
(45) Date of Patent: Mar. 8, 2022

(54) METHOD FOR MANUFACTURING INORGANIC PARTICLE COMPOSITE FIBER SHEET

(71) Applicant: NIPPON PAPER INDUSTRIES CO., LTD., Tokyo (JP)

(72) Inventors: Ayaka Hasegawa, Tokyo (JP); Moe Fukuoka, Tokyo (JP); Masatoshi Oishi, Tokyo (JP); Koji Ninagawa, Tokyo (JP); Toru Nakatani, Tokyo (JP); Shisei Goto, Tokyo (JP)

(73) Assignee: NIPPON PAPER INDUSTRIES CO., LTD, Tokyo (JP)

( * ) Notice: Subject to any disclaimer, the term of this patent is extended or adjusted under 35 U.S.C. 154(b) by 0 days.

(21) Appl. No.: 16/497,868

(22) PCT Filed: Mar. 19, 2018

(86) PCT No.: PCT/JP2018/010792
§ 371 (c)(1),
(2) Date: Sep. 26, 2019

(87) PCT Pub. No.: WO2018/180699
PCT Pub. Date: Oct. 4, 2018

(65) Prior Publication Data

US 2020/0024804 A1 Jan. 23, 2020

(30) Foreign Application Priority Data

Mar. 31, 2017 (JP) ..... JP2017-073022

(51) Int. Cl.
*D21H 17/67* (2006.01)
*D21H 17/70* (2006.01)
(Continued)

(52) U.S. Cl.
CPC ..... *D21H 17/67* (2013.01); *D21C 9/004* (2013.01); *D21F 9/02* (2013.01); *D21H 11/04* (2013.01); *D21H 21/06* (2013.01); *D21H 27/30* (2013.01)

(58) Field of Classification Search
CPC ..... D21H 17/70; D21H 15/12; D21H 7/67; D21H 17/675; D21C 9/004
(Continued)

(56) References Cited

U.S. PATENT DOCUMENTS 105,594 A * 7/1870 Pemberton ..... D21H 17/70 162/181.3
5,096,539 A 3/1992 Allan
(Continued)

FOREIGN PATENT DOCUMENTS

AU 2003248412 A1 11/2003
CA 2944320 A1 10/2015
(Continued)

OTHER PUBLICATIONS

Paper Grades, Richard Venditti, North Carolina State University (Year: 2017).*
(Continued)

*Primary Examiner* — Eric Hug
(74) *Attorney, Agent, or Firm* — Kristina Castellnao; Castellano PLLC

(57) ABSTRACT

The present invention provides a method for reducing web break caused in preparing, by continuous paper making, a fiber sheet containing a high content of functional inorganic substance. The composite fiber sheet manufacturing method includes: generating composite fibers composed of cellulosic fibers and inorganic particles by synthesizing the inorganic particles in slurry containing the cellulosic fibers; and continuously generating a sheet by supplying compos-
(Continued)

ite-fiber-containing slurry including the composite fibers to a continuous paper machine. In the composite fiber generating step, at least one of (i) slurry containing cellulosic fibers having a length of 1.2 mm to 2.0 mm in an amount of 16% or more in terms of length-weighted fiber length distribution (%) and (ii) slurry containing cellulosic fibers having a length of 1.2 mm to 3.2 mm in an amount of 30% or more in terms of length-weighted fiber length distribution (%) is used.

10 Claims, 2 Drawing Sheets

(51) Int. Cl.

| | |
|---|---|
| ***D21H 27/30*** | (2006.01) |
| ***D21H 15/12*** | (2006.01) |
| ***D21C 9/00*** | (2006.01) |
| ***D21F 9/02*** | (2006.01) |
| ***D21H 11/04*** | (2006.01) |
| ***D21H 21/06*** | (2006.01) |

(58) Field of Classification Search
USPC ..... 162/181.1, 181.2, 181.3, 182, 183
See application file for complete search history.

(56) References Cited

U.S. PATENT DOCUMENTS

| | | | | |
|---|---|---|---|---|
| 5,143,583 | A | 9/1992 | Marchessault et al. | |
| 5,223,090 | A * | 6/1993 | Klungness | D21C 9/004 162/9 |
| 5,262,006 | A * | 11/1993 | Andersson | D21H 23/08 162/147 |
| 5,505,819 | A | 4/1996 | DeWitt et al. | |
| 5,679,220 | A | 10/1997 | Matthew et al. | |
| 5,731,080 | A | 3/1998 | Cousin et al. | |
| 5,824,364 | A | 10/1998 | Cousin et al. | |
| 5,945,211 | A | 8/1999 | Yamaguchi et al. | |
| 6,180,764 | B1 | 6/2001 | Noweck et al. | |
| 6,376,057 | B1 | 4/2002 | Akao et al. | |
| 6,436,232 | B1 | 8/2002 | Silenius et al. | |
| 6,592,712 | B2 * | 7/2003 | Koukoulas | D21H 17/70 162/100 |
| 2002/0026989 | A1 | 3/2002 | Rheims et al. | |
| 2003/0094252 | A1 | 5/2003 | Sundar et al. | |
| 2004/0108081 | A1 | 6/2004 | Hughes | |
| 2004/0108082 | A1 | 6/2004 | Hughes | |
| 2004/0108083 | A1 | 6/2004 | Hughes | |
| 2004/0168779 | A1 | 9/2004 | Silenius et al. | |
| 2005/0011623 | A1 | 1/2005 | West et al. | |
| 2005/0121157 | A1 | 6/2005 | Doelle et al. | |
| 2005/0129606 | A1 | 6/2005 | Mitsuhashi et al. | |
| 2006/0032596 | A1 | 2/2006 | Leskela et al. | |
| 2006/0113051 | A1 | 6/2006 | Dolle | |
| 2007/0131360 | A1 | 6/2007 | Sipila et al. | |
| 2007/0144419 | A1 | 6/2007 | Lee | |
| 2008/0090032 | A1 | 4/2008 | Perrin et al. | |
| 2009/0162658 | A1 | 6/2009 | Wolk et al. | |
| 2009/0229772 | A1 | 9/2009 | Riou | |
| 2010/0212853 | A1 * | 8/2010 | Klungness | D21H 17/70 162/181.4 |
| 2010/0331457 | A1 | 12/2010 | Buri et al. | |
| 2012/0080155 | A1 | 4/2012 | Konishi | |
| 2013/0126116 | A1 | 5/2013 | Solismaa | |
| 2013/0142852 | A1 | 6/2013 | Tojo et al. | |
| 2013/0312925 | A1 | 11/2013 | Saastamoinen et al. | |
| 2014/0352903 | A1 | 12/2014 | Ernegg | |
| 2015/0164710 | A1 | 6/2015 | Ehkme et al. | |
| 2015/0167244 | A1 | 6/2015 | Solismaa | |
| 2017/0107668 | A1 | 4/2017 | Fukuoka et al. | |
| 2017/0113945 | A1 | 4/2017 | Fukuoka et al. | |
| 2018/0066072 | A1 | 3/2018 | Takaichi et al. | |
| 2018/0274174 | A1 | 9/2018 | Tanaka et al. | |
| 2018/0282936 | A1 | 10/2018 | Fukuoka et al. | |
| 2018/0346333 | A1 | 12/2018 | Fukuoka et al. | |
| 2019/0047872 | A1 | 2/2019 | Fukuoka et al. | |

FOREIGN PATENT DOCUMENTS

| | | | |
|---|---|---|---|
| CN | 1673267 | A | 9/2005 |
| CN | 1723315 | A | 1/2006 |
| CN | 1723316 | A | 1/2006 |
| CN | 102459757 | A | 5/2012 |
| CN | 103339322 | A | 10/2013 |
| EP | 0261820 | A1 | 3/1988 |
| EP | 1749131 | | 2/2007 |
| EP | 2781651 | | 9/2014 |
| EP | 3075901 | A1 | 10/2016 |
| EP | 3127868 | A1 | 2/2017 |
| JP | 54-023708 | | 2/1979 |
| JP | 62-162098 | | 7/1987 |
| JP | 04-263615 | A | 9/1992 |
| JP | 06-158585 | | 6/1994 |
| JP | 6-507944 | | 9/1994 |
| JP | 7-184774 | | 7/1995 |
| JP | 07-279089 | A | 10/1995 |
| JP | 9-95900 | | 4/1997 |
| JP | 09-175819 | A | 7/1997 |
| JP | 9-286615 | | 11/1997 |
| JP | 09-294485 | A | 11/1997 |
| JP | 9-316794 | | 12/1997 |
| JP | 10-226997 | A | 8/1998 |
| JP | 11-081127 | | 3/1999 |
| JP | 2000-144522 | A | 5/2000 |
| JP | 2000-220097 | | 8/2000 |
| JP | 2002-030592 | | 1/2002 |
| JP | 2003-251725 | | 9/2003 |
| JP | 2003-306325 | | 10/2003 |
| JP | 2003-342894 | | 12/2003 |
| JP | 2004-360144 | A | 12/2004 |
| JP | 2005-048351 | | 2/2005 |
| JP | 2005-505708 | | 2/2005 |
| JP | 2006-503997 | | 2/2006 |
| JP | 2006-206660 | A | 8/2006 |
| JP | 2007-262635 | A | 10/2007 |
| JP | 2007-528947 | | 10/2007 |
| JP | 2009-143798 | A | 7/2009 |
| JP | 2011-506789 | | 3/2011 |
| JP | 2012-007247 | | 1/2012 |
| JP | 2012-144829 | A | 8/2012 |
| JP | 2013-085568 | A | 5/2013 |
| JP | 2013-096026 | | 5/2013 |
| JP | 2013-170329 | | 9/2013 |
| JP | 2013-536329 | | 9/2013 |
| JP | 2015-071843 | | 4/2015 |
| JP | 2015-525628 | | 9/2015 |
| JP | 2015-193000 | A | 11/2015 |
| JP | 2015-199655 | | 11/2015 |
| JP | 2015-199660 | | 11/2015 |
| JP | 2015199658 | | 11/2015 |
| WO | 2004-038101 | A1 | 5/2004 |
| WO | 2005/005726 | A1 | 1/2005 |
| WO | 2005/111306 | A1 | 11/2005 |
| WO | 2011-042607 | | 4/2011 |
| WO | 2012/002390 | | 1/2012 |
| WO | 2012/022836 | A1 | 2/2012 |
| WO | 2015/152283 | | 10/2015 |
| WO | 2016-186055 | | 11/2016 |
| WO | 2017/043580 | | 3/2017 |
| WO | 2017/043585 | | 3/2017 |
| WO | 2017/047699 | | 3/2017 |
| WO | 2017/057154 | | 4/2017 |

OTHER PUBLICATIONS

European Search Report in application 18775590.5, dated Mar. 16, 2020.

Notification of Reasons for Refusal (Office Action) in Japanese application 2019-092369 dated May 26, 2020, and corresponding English language translation.

(56) References Cited

OTHER PUBLICATIONS

Office Action for corresponding JP application 2018-544282, dated Dec. 18, 2018, and full English language translation.
Subramanian, Ramjee et al., "Calcium Carbonate-Cellulose Fibre Composites; The Role of Pulp Refining", Paper Technology, vol. 47. No. 8, Paper Industry Technical Association, 2006. 12, p. 27-31.
English translation of International preliminary report on patentability of PCT/JP2018/010792, 2018.
International Search Report for PCT/JP2018/010792 dated Jun. 19, 2018.
Office Action for JP application 2018-553024 dated Jun. 29, 2021.
Mekdad et al (Effect of Mg/Al ratio and of the rate of reinforcement on the synthesis of a nanocomposite Cellulose/Hydrotalcite, Journal of Advances in Chemistry, 2014) (Year: 2014).
Notice of Allowance For U.S. Appl. No. 16/318,368, dated Apr. 5, 2021.
Office Action For U.S. Appl. No. 16/318,368 dated Dec. 10, 2020.
Seida, Adsorption Behavior of Layered Double Hydroxide for Surfactants during Reconstruction Process from Its Heat-treated Solid Solution and Structural Stability of Its Emulsion Gel. Bulletin of Toyo University, Natural Sciences. 2012;56:43-52.
Oshima et al., Ability to Remove Phosphorus from Wastewater Using Hydrotalcite-Carrying Fiber (HTCF). Journal of Japan Society on Water Environment. 2007;30(11):671-676.
"Honda et al., Synthesis and Ion Exchange Properties of Magnesium-Iron (III) and -Aluminum hydrotalcite like compounds. J Ion Exchange. 2005;16(1):41-48."
Office Action For U.S. Appl. No. 16/318,368, dated Jun. 24, 2020.
Extended European Search Report for EP Application No. 178395851, dated Mar. 27, 2020, 7 pages, dated Mar. 27, 2020.
Office Action For U.S. Appl. No. 16/318,368, dated Mar. 9, 2020.
International Search Report for Application No. PCT/JP2017/029131, dated Nov. 14, 2017, 2 pages, dated Nov. 14, 2017.
U.S. Office Action For U.S. Appl. No. 16/464,263, dated Aug. 7, 2020.
EP Office Action For 17874567.5 dated Aug. 19, 2019.
EP Search report for 17874567.5 dated Aug. 19, 2019.
English Translation of International Preliminary Report on Patentability for PCT/JP2017/042681, dated May 28, 2019.
International Search Report for PCT/JP2017/042681, dated Feb. 20, 2018.
U.S. Office Action For U.S. Appl. No. 16/464,263, dated May 12, 2021.
Office Action For related Chinese application 201880022070.3 dated Jul. 5, 2021.
Office Action dated Oct. 21, 2021 in U.S. Appl. No. 16/464,263.

* cited by examiner

METHOD FOR MANUFACTURING INORGANIC PARTICLE COMPOSITE FIBER SHEET

CROSS REFERENCE TO RELATED APPLICATIONS

This application is a U.S. National Stage application of PCT/JP2018/010792 filed on Mar. 19, 2018, which claims priority to Japanese patent application 2017-073022 filed on Mar. 31, 2017, the contents of both of which are incorporated herein by reference.

TECHNICAL FIELD

The present invention relates to a method for manufacturing an inorganic particle composite fiber sheet.

BACKGROUND ART

A continuous paper machine is used in order to produce a large amount of sheets containing fibers (such as cellulosic fibers) which are dispersed in water. Patent Literature 1 discloses a method for manufacturing, with use of a continuous paper machine, a sheet that contains filaments having an average fiber diameter of 1 nm to 1000 nm.

CITATION LIST

Patent Literature

[Patent Literature 1]
Japanese Patent Application Publication Tokukai No. 2013-96026 (Publication Date: May 20, 2013)

SUMMARY OF INVENTION

Technical Problem

Depending on an application of sheet, e.g., in a case where functionality is imparted to a sheet to be manufactured, an inorganic substance having a function may be mixed with fibers in making the sheet with a continuous paper making technique. In order to achieve higher functionality, the inorganic substance needs to be contained in a larger amount.

However, in the sheet which contains the larger amount of inorganic substance, hydrogen bonds between cellulosic fibers are split by the inorganic substance, and thus paper strength of the sheet is low. From this, web break is more likely to occur in continuous paper making. Moreover, small inorganic particles tend to leak through meshes of the paper machine, and there is a limitation on an amount of such inorganic particles to be contained.

As a measure for increasing hydrogen bonds between cellulosic fibers and for heightening retention of inorganic substances, strength of beating pulp may be enhanced. However, freeness decreases when pulp is beaten, and accordingly dehydration property of a sheet which is being made decreases. From this, a time taken to carry out dehydration increases. In particular, in a case where a sheet having a high basis weight is made, such a sheet needs to be made with a low-speed paper making technique. In such a low-speed paper making technique, web break is more likely to occur due to dirt generated in a press and a dryer part and also due to unevenness of moisture. This leads to decrease in productivity.

An aspect of the present invention is accomplished in view of such circumstances, and its object is to provide a method for reducing web break that may occur in preparing, by continuous paper making, a fiber sheet which contains a high content of functional inorganic substance.

Solution to Problem

The present invention encompasses but not limited to the following features:

(1) A method for manufacturing an inorganic particle composite fiber sheet, the method including: a composite fiber generating step of generating composite fibers composed of cellulosic fibers and inorganic particles by synthesizing the inorganic particles in slurry containing the cellulosic fibers; and a sheet generating step of continuously generating a sheet by supplying composite-fiber-containing slurry including the composite fibers to a continuous paper machine, the composite fiber generating step being carried out while using at least one of (i) slurry in which cellulosic fibers having a length of 1.2 mm to 2.0 mm are contained in an amount of 16% or more in terms of length-weighted fiber length distribution (%) and (ii) slurry in which cellulosic fibers having a length of 1.2 mm to 3.2 mm are contained in an amount of 30% or more in terms of length-weighted fiber length distribution (%).

Advantageous Effects of Invention

According to an aspect of the present invention, it is possible to bring about an effect of reducing web break that may occur in preparing, by continuous paper making, a fiber sheet which contains a high content of functional inorganic substance.

DESCRIPTION OF EMBODIMENTS

Figure 1:
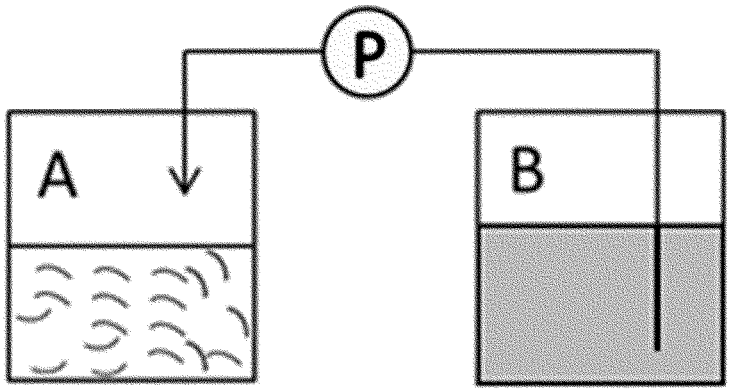
FIG. 1 is a schematic view schematically illustrating a configuration of a reactor which was used in Examples to synthesize composite fibers from barium sulfate and cellulosic fibers and to synthesize composite fibers from hydrotalcite and cellulosic fibers.

The following description will discuss embodiments of the present invention in detail. Note, however, that the present invention is not limited to those embodiments, and can be made in an aspect obtained by variously altering the embodiments within the described scope. Note that numerical expressions such as "A to B" herein mean "not less than A and not more than B" unless otherwise stated.

<Method for Manufacturing Inorganic Particle Composite Fiber Sheet>

The method for manufacturing an inorganic particle composite fiber sheet in accordance with an aspect of the present invention includes: a composite fiber generating step of generating composite fibers composed of cellulosic fibers and inorganic particles by synthesizing the inorganic particles in slurry containing the cellulosic fibers; and a sheet generating step of continuously generating a sheet by supplying composite-fiber-containing slurry including the composite fibers to a continuous paper machine, the composite fiber generating step being carried out while using at least one of (i) slurry in which cellulosic fibers having a length of 1.2 mm to 2.0 mm are contained in an amount of 16% or more in terms of length-weighted fiber length distribution (%) and (ii) slurry in which cellulosic fibers having a length of 1.2 mm to 3.2 mm are contained in an amount of 30% or more in terms of length-weighted fiber length distribution (%). From this, it is possible to reduce web break that may occur in preparing, by continuous paper making, a fiber sheet which contains a high content of functional inorganic substance. Further, according to the method for manufacturing the inorganic particle composite fiber sheet in accordance with an aspect of the present invention, the composite fibers containing the cellulosic fibers and the inorganic particles are formed into a sheet, and it is therefore possible to manufacture a sheet having a high ash content at a high yield. Note that, in this specification, the "inorganic particle composite fiber sheet" is sometimes simply referred to as "composite fiber sheet".

The method in accordance with an aspect of the present invention is applicable to cases of manufacturing sheets having various specific surface areas. The method for manufacturing the inorganic particle composite fiber sheet in accordance with an aspect of the present invention is suitably applicable also to a case of manufacturing a sheet having a large specific surface area. For example, the method in accordance with an aspect of the present invention is applicable to a case of manufacturing a sheet having a specific surface area of 5 $m^2/g$ or more and 100 $m^2/g$ or less, and is suitably applicable also to a case of manufacturing a sheet having a large specific surface area of 7 $m^2/g$ or more.

The method in accordance with an aspect of the present invention is applicable to cases of manufacturing sheets having various ash contents. The method for manufacturing the inorganic particle composite fiber sheet in accordance with an aspect of the present invention is suitably applicable also to a case of manufacturing a sheet having a high ash content. For example, even in a case where a sheet having an ash content (defined in JIS P 8251:2003) of 15% or higher and 80% or lower is manufactured by a continuous paper machine, the method in accordance with an aspect of the present invention can reduce web break.

The method in accordance with an aspect of the present invention is applicable to cases of manufacturing sheets having various basis weights. The method for manufacturing the inorganic particle composite fiber sheet in accordance with an aspect of the present invention is suitably applicable also to a case of manufacturing a sheet having a high basis weight. For example, even in a case where a sheet having a basis weight of 30 $g/m^2$ or more and 600 $g/m^2$ or less, preferably a basis weight of 50 $g/m^2$ or more and 600 $g/m^2$ or less is manufactured by use of a continuous paper machine, the method in accordance with an aspect of the present invention can reduce web break.

The method in accordance with an aspect of the present invention is applicable to cases of manufacturing sheets at various paper making speeds. According to the method in accordance with an aspect of the present invention, it is possible to manufacture a sheet by use of a continuous paper machine without web break. As such, depending on a basis weight of a sheet to be made, the method is suitably applicable also to a case of manufacturing a sheet by high speed paper making. For example, in a case where a composite fiber sheet having a basis weight of 180 $g/m^2$ to 600 $g/m^2$ is made with use of a Fourdrinier machine, the sheet can be manufactured without web break, provided that a paper making speed is 10 m/min or more and 400 m/min or less. Alternatively, in a case where a composite fiber sheet having a basis weight of 30 $g/m^2$ to 180 $g/m^2$ is made with use of a Fourdrinier machine, the sheet can be manufactured without web break, provided that a paper making speed is 10 m/min or more and 1000 m/min or less.

[1. Composite Fiber Generating Step]

The composite fiber generating step is a step of generating a composite fiber from cellulosic fibers and inorganic particles. In the composite fiber generating step, the composite fiber is generated by synthesizing the inorganic particles in slurry containing the cellulosic fibers.

(Method for Generating Composite Fibers)

By synthesizing inorganic particles in slurry containing cellulosic fibers, it is possible to generate composite fibers in which intended inorganic particles are complexed with the cellulosic fibers. A method of synthesizing inorganic particles in slurry containing cellulosic fibers can be either a gas-liquid method or a liquid-liquid method. An example of the gas-liquid method is a carbon dioxide process in which, for example, magnesium carbonate can be synthesized by causing magnesium hydroxide to react with carbonic acid gas. Examples of the liquid-liquid method include a method in which an acid (such as hydrochloric acid or sulfuric acid) is caused to react with a base (such as sodium hydroxide or potassium hydroxide) by neutralization; a method in which an inorganic salt is caused to react with an acid or a base; or a method in which inorganic salts are caused to react with each other. For example, barium sulfate can be obtained by causing barium hydroxide to react with sulfuric acid, aluminum hydroxide can be obtained by causing aluminum sulfate to react with sodium hydroxide, and inorganic particles in which calcium and aluminum are complexed can be obtained by causing calcium carbonate to react with aluminum sulfate. In synthesizing inorganic particles in this manner, any metal or metal compound can coexist in a reaction liquid. In such a case, the metal or metal compound can be efficiently incorporated into and complexed with the inorganic particles. For example, in a case where phosphoric acid is added to calcium carbonate to synthesize calcium phosphate, composite particles of calcium phosphate and titanium can be obtained by causing titanium dioxide to coexist in the reaction liquid.

In a case where two or more types of inorganic particles are complexed with cellulosic fibers, it is possible that synthetic reaction of one type of inorganic particles is carried out in the presence of the cellulosic fibers, then the synthetic reaction is halted, and then another synthetic reaction of the other type of inorganic particles is carried out. Two or more types of inorganic particles can be simultaneously synthesized, provided that those types of inorganic particles do not obstruct reactions each other or two or more types of intended inorganic particles are synthesized by one reaction.

Inorganic particles having various sizes and shapes can be complexed with fibers into composite fibers by adjusting the condition for synthesizing inorganic particles. For example, it is possible to provide composite fibers in which fibers are complexed with scale-shaped inorganic particles. A shape of inorganic particles constituting the composite fibers can be confirmed by observation with use of an electron microscope.

As one preferable aspect, an average primary particle diameter of the inorganic particles in the composite fibers can be, for example, 1 μm or less. Alternatively, it is possible to use inorganic particles having an average primary particle diameter of 500 nm or less, inorganic particles having an average primary particle diameter of 200 nm or less, inorganic particles having an average primary particle diameter of 100 nm or less, and inorganic particles having an average primary particle diameter of 50 nm or less. The average primary particle diameter of inorganic particles can be 10 nm or more. Note that the average primary particle diameter can be calculated based on electron micrography.

The inorganic particles can have a form of secondary particles obtained by aggregation of fine primary particles. Such secondary particles can be generated by a ripening process in accordance with a purpose of use. The aggregate can be made smaller by pulverization. Examples of a pulverizing method include a ball mill, a sand grinder mill, an impact mill, a high-pressure homogenizer, a low-pressure homogenizer, a Dinomill, an ultrasonic mill, a Kanda grinder, an attritor, a stone mill, a vibrating mill, a cutter mill, a jet mill, a disintegrator, a beating machine, a short-screw extruder, a twin-screw extruder, an ultrasonic stirrer, a household juicer mixer, and the like.

(Cellulosic Fibers)

Examples of the raw material of cellulosic fibers include pulp fibers (wood pulp and non-wood pulp), cellulose nanofibers, bacterial cellulose, animal-derived cellulose such as ascidian, and algae, and the wood pulp can be produced by converting wood feedstock into pulp. Examples of the wood feedstock include coniferous trees such as Japanese red pine, Japanese black pine, Sakhalin fir, Yezo spruce, *Pinus koraiensis*, Japanese larch, Japanese fir, Southern Japanese hemlock, Japanese cedar, Hinoki cypress, Japanese larch, *Abies veitchii*, spruce, Hinoki cypress leaf, Douglas fir, hemlock, white fir, spruce, Balsam fir, cedar, pine, Merkusii pine, and *Radiata* pine, and admixtures thereof; and broadleaf trees such as Japanese beech, birch, Japanese alder, oak, *Machilus thunbergii*, Castanopsis, Japanese white birch, Japanese aspen, poplar, Japanese ash, Japanese poplar, eucalyptus, mangrove, lauan, and acacia, and admixtures thereof.

A method for converting the natural material such as wood feedstock (woody raw material) into pulp is not particularly limited, and, for example, a pulping method commonly used in the paper industry can be employed. Wood pulp can be classified, in accordance with the pulping method, into, for example, chemical pulp digested by a kraft method, a sulfite method, the soda method, a polysulfide method, or the like; mechanical pulp obtained by pulping with mechanical force such as a refiner, a grinder, or the like; semi-chemical pulp obtained by pulping with mechanical force after pretreatment with chemicals; wastepaper pulp; deinked pulp; and the like. The wood pulp can be unbleached (i.e., before bleaching) or bleached (i.e., after bleaching).

Examples of the non-wood pulp include cotton, hemp, sisal hemp, Manila hemp, flax, straw, bamboo, bagasse, kenaf, sugar cane, corn, rice straw, paper mulberry, paper bush, and the like.

The pulp fibers can be either unbeaten or beaten, and can be selected according to physical properties of the composite fibers. It is preferable that the pulp fibers are beaten. By the beating, it is possible to expect improvement in strength of the pulp fibers and promotion of fixing of inorganic particles to the pulp fibers. Moreover, in an aspect in which sheet-shaped composite fibers are obtained by beating pulp fibers, it is possible to expect an effect of improving a BET specific surface area of the composite fiber sheet. Note that a degree of beating of pulp fibers can be represented by Canadian standard freeness (CSF) that is defined in JIS P 8121-2:2012. As the beating proceeds, a drainage state of pulp fibers is deteriorated, and freeness becomes lower.

According to an aspect of the present invention, freeness of cellulosic fibers used to synthesize composite fibers is not particularly limited. For example, it is possible to suitably use cellulosic fibers having freeness of 600 mL or lower. According to the method for manufacturing the composite fiber sheet in accordance with an aspect of the present invention, it is possible to inhibit web break in making, by continuous paper making, a sheet of cellulosic fibers having freeness of 600 mL or lower. That is, in a case where treatment for increasing a surface area of fibers is carried out by beating or the like in order to improve strength and specific surface area of a composite fiber sheet, freeness of cellulosic fibers becomes lower. However, cellulosic fibers subjected to such a treatment can also be suitably used. A lower limit of freeness of cellulosic fibers is more preferably 50 mL or higher, further preferably 100 mL or higher. In a case where the freeness of cellulosic fibers is 200 mL or higher, it is possible to achieve good productivity of continuous paper making.

These cellulose raw materials can also be further processed to be used as pulverized cellulose, chemically denatured cellulose such as oxidized cellulose, and cellulose nanofibers: CNF (microfibrillated cellulose: MFC, TEMPO-oxidized CNF, phosphoric acid esterified CNF, carboxymethylated CNF, mechanically pulverized CNF, and the like). The pulverized cellulose includes both (a) cellulose that is generally called powdered cellulose and (b) the mechanically pulverized CNF. As the powdered cellulose, for example, it is possible to use (i) powdered cellulose produced by mechanically pulverizing carefully selected untreated pulp or crystalline cellulose powder that has a fixed particle size distribution, is in a rod-like shape, and is produced by refining, drying, pulverizing and sieving undecomposed residues obtained after acid hydrolysis, or (ii) commercially available products such as KC Flock (manufactured by Nippon Paper Industries, Co. Ltd.), CEOLUS (manufactured by Asahi Kasei Chemicals Corporation) and Avicel (manufactured by FMC). A degree of polymerization of cellulose in the powdered cellulose is preferably approximately 100 to 1500, a degree of crystallinity of the powdered cellulose by X-ray diffractometry is preferably 70% to 90%, and a volume average particle diameter measured by a laser diffraction particle size distribution measuring device is preferably 1 μm to 100 μm. The oxidized cellulose can be obtained, for example, by oxidation in water with an oxidizer in the presence of N-oxyl compound and a compound selected from the group consisting of bromide, iodide and a mixture thereof. The cellulose nanofibers can be obtained by a method of fibrillating the cellulose raw material. Examples of the fibrillating method include a method in which a water suspension or the like of cellulose or chemically denatured cellulose such as oxidized cellulose is mechanically ground or beaten with use of a refiner, a high-pressure homogenizer, a grinder, a uniaxial or multiaxial kneader, a bead mill, or the like, so that the cellulose or chemically denatured cellulose is fibrillated. One or more of the above methods can be combined to produce cellulose nanofibers. A fiber diameter of the produced cellulose nanofibers can be confirmed by electron microscopy or the like, and ranges, for example, from 5 nm to 1000 nm, preferably from 5 nm to 500 nm, more preferably from 5 nm to 300 nm. In producing the cellulose nanofibers, it is possible that an optional compound is further added to react with the cellulose nanofibers to modify a hydroxyl group, before and/or after the cellulose is fibrillated and/or made finer. Examples of modifying functional groups include an acetyl group, an ester group, an ether group, a ketone group, a formyl group, a benzoyl group, acetal, hemiacetal, oxime, isonitrile, allene, a thiol group, a urea group, a cyano group, a nitro group, an azo group, an aryl group, an aralkyl group, an amino group, an amide group, an imido group, an acrylyl group, a methacryloyl group, a propionyl group, a propioloyl group, a butyryl group, a 2-butyryl group, a pentanoyl group, a hexanoyl group, a heptanoyl group, an octanoyl group, a nonanoyl group, a decanoyl group, an undecanoyl group, a dodecanoyl group, a myristoyl group, a palmitoyl group, a stearoyl group, a pivaloyl group, a benzoyl group, a naphthoyl group, a nicotinoyl group, an isonicotinoyl group, a furoyl group, an acyl group such as a cinnamoyl group, an isocyanate group such as a 2-methacryloyloxyethyl isocyanoyl group, a methyl group, an ethyl group, a propyl group, a 2-propyl group, a butyl group, a 2-butyl group, a tert-butyl group, a pentyl group, a hexyl group, a heptyl group, an octyl group, a nonyl group, a decyl group, an undecyl group, a dodecyl group, a myristyl group, a palmityl group, an alkyl group such as a stearyl group, an oxirane group, an oxetane group, an oxyl group, a thiirane group, a thietane group, and the like. Hydrogens in these substituents can be substituted with a functional group such as a hydroxyl group or a carboxy group. Moreover, a part of alkyl group can be an unsaturated bond. A compound used to introduce these functional groups is not particularly limited, and examples of such a compound include a compound having a group derived from phosphoric acid, a compound having a group derived from carboxylic acid, a compound having a group derived from sulfuric acid, a compound having a group derived from sulfonic acid, a compound having an alkyl group, a compound having a group derived from amine, and the like. The compound having the phosphoric acid group is not particularly limited, and examples of such a compound include phosphoric acid, and lithium dihydrogen phosphate, dilithium hydrogen phosphate, trilithium phosphate, lithium pyrophosphate, and lithium polyphosphate which are lithium salts of phosphoric acid. Further, examples of the compound having the phosphoric acid group include sodium dihydrogen phosphate, disodium hydrogen phosphate, trisodium phosphate, sodium pyrophosphate, and sodium polyphosphate, which are sodium salts of phosphoric acid. Further, examples of the compound having the phosphoric acid group include potassium dihydrogen phosphate, dipotassium hydrogen phosphate, tripotassium phosphate, potassium pyrophosphate, and potassium polyphosphate, which are potassium salts of phosphoric acid. Further, examples of the compound having the phosphoric acid group include ammonium dihydrogen phosphate, diammonium hydrogen phosphate, triammonium phosphate, ammonium pyrophosphate, ammonium polyphosphate, and the like which are ammonium salts of phosphoric acid. Among these, phosphoric acid, sodium salts of phosphoric acid, potassium salts of phosphoric acid, and ammonium salts of phosphoric acid are preferable, and sodium dihydrogen phosphate and disodium hydrogen phosphate are more preferable, from the viewpoint of efficient introduction of the phosphoric acid group and easy industrial application. Note, however, that the compound having the phosphoric acid group is not particularly limited. The compound having carboxyl group is not particularly limited, and examples of the compound include dicarboxylic acid compounds such as maleic acid, succinic acid, phthalic acid, fumaric acid, glutaric acid, adipic acid, and itaconic acid, and tricarboxylic acid compounds such as citric acid, and aconitic acid. An acid anhydride of the compound having carboxyl group is not particularly limited, and examples of the acid anhydride include acid anhydrides of dicarboxylic acid compounds such as maleic anhydride, succinic anhydride, phthalic anhydride, glutaric anhydride, adipic anhydride, and itaconic anhydride. A derivative of the compound having carboxyl group is not particularly limited, and examples of the derivative includes (i) an imide compound of acid anhydride of the compound having carboxyl group and (ii) a derivative of acid anhydride of the compound having carboxyl group.

The imide compound of acid anhydride of the compound having carboxyl group is not particularly limited, and examples of the imide compound include imide compounds of dicarboxylic acid compounds such as maleimide, succinimide, and phthalic imide. A derivative of acid anhydride of the compound having carboxyl group is not particularly limited. Examples of the derivative include those in which at least part of hydrogen atoms of an acid anhydride of the compound having carboxyl group (such as dimethylmaleic anhydride, diethylmaleic anhydride, and diphenylmaleic anhydride) are substituted with a substituent (e.g., an alkyl group, a phenyl group, and the like). Among the compound having a group derived from carboxylic acid, maleic anhydride, succinic anhydride, and phthalic anhydride are preferable because those are easily applied industrially and easily gasified. Note, however, that the compound having a group derived from carboxylic acid is not particularly limited. Alternatively, the cellulose nanofibers can be modified in a manner in which a modifying compound is physically adsorbed onto the cellulose nanofibers, without being chemically bound to the cellulose nanofibers. The compound to be physically adsorbed includes a surfactant or the like, and any one of anionic surfactant, cationic surfactant, and nonionic surfactant can be used. In a case where the modification is carried out with respect to the cellulose prior to fibrillating and/or pulverizing the cellulose, it is possible that those functional groups are desorbed after the fibrillating and/or pulverizing so that the original hydroxyl group is restored. By subjecting the cellulose to such modification, it is possible to facilitate fibrillation of the cellulose nanofibers and to make it easier to mix the cellulose nanofibers with various materials.

In a preferable aspect of the present invention, fibers constituting the composite fibers are pulp fibers. For example, a fibrous substance recovered from paper mill wastewater can be supplied to slurry for synthetic reaction of inorganic particles in the composite fiber generating step. By supplying such a substance to a reaction tank, various composite particles can be synthesized and also, in terms of shape, fibrous particles or the like can be synthesized.

Moreover, in addition to the fibers, substances can be used which do not directly participate in synthetic reaction of intended inorganic particles but are incorporated into the intended inorganic particles, which have been produced, to form composite particles. For example, in an aspect in which fibers such as pulp fibers are used, it is possible to synthesize intended inorganic particles in a solution containing inorganic particles, organic particles, a polymer, and the like in addition to the pulp fibers, and thus composite particles can be produced into which those substances are incorporated.

The above exemplified fibers can be used alone or two or more types of those fibers can be used in combination.

The composite fiber generating step is carried out while using at least one of (i) slurry in which cellulosic fibers having a length of 1.2 mm to 2.0 mm are contained in an amount of 16% or more (preferably 19% or more) in terms of length-weighted fiber length distribution (%) and (ii) slurry in which cellulosic fibers having a length of 1.2 mm to 3.2 mm are contained in an amount of 30% or more (preferably 35% or more) in terms of length-weighted fiber length distribution (%). In a case where the cellulosic fibers constituting the composite fibers have the above fiber length distribution, it is possible to inhibit web break in making, by continuous paper making, a fiber sheet that contains a high content of functional inorganic substance. A length-weighted fiber length distribution of cellulosic fibers contained in slurry can be measured by, for example, an optical measurement method (see JAPAN TAPPI paper pulp test method No. 52 (Pulps and paper—Fiber length test method—automated optical measurement) or JIS P 8226 (Pulps—Determination of fibre length by automated optical analysis—Part 1: Polarized light method), JIS P 8226-2 (Pulps—Determination of fibre length by automated optical analysis—Part 2: Unpolarized light method)). A length-weighted mean length of cellulosic fibers contained in slurry used in the composite fiber generating step is more preferably 1.2 mm or more and 1.5 mm or less. In a case where the cellulosic fibers constituting the composite fibers have the above length-weighted mean length, it is possible to inhibit web break in making, by continuous paper making, a fiber sheet that contains a high content of functional inorganic substance.

A method for preparing slurry in which a length-weighted fiber length distribution of cellulosic fibers contained in the slurry falls within the above range is not particularly limited, and a method for preparing slurry in which a length-weighted mean length of cellulosic fibers contained in the slurry falls within the above range is not particularly limited. For example, the slurry can be prepared by mixing cellulosic fibers (for convenience, referred to as "cellulosic fiber group A") having a length-weighted mean length of 1.0 mm or more and 2.0 mm or less in an amount of not less than 60% by weight with respect to a total amount of cellulosic fibers used in synthesizing composite fibers. Note that the "length-weighted mean length" can be measured by, for example, using publicly known Metso Fractionater (manufactured by Metso). It is preferable to employ needle bleached kraft pulp as the cellulosic fiber group A because needle bleached kraft pulp has a long fiber length and is advantageous in improvement of strength.

The length-weighted mean length of the cellulosic fiber group A can be 1.0 mm or more and 2.0 mm or less, preferably 1.2 mm or more and 1.6 mm or less, more preferably 1.4 mm or more and 1.6 mm or less. In a case where the length-weighted mean length is 1.2 mm or more, strength of an obtained sheet improves. In a case where the length-weighted mean length is 1.6 mm or less, it is possible to inhibit unevenness of gaps in an obtained sheet.

The length-weighted mean length of cellulose can be achieved by, for example, adjusting a ratio between (i) leaf bleached kraft pulp (LBKP; having a length-weighted mean length of less than 1.0 mm) and (ii) needle bleached kraft pulp (NBKP), needle unbleached kraft pulp (NUKP), or thermomechanical pulp (TMP) (each having a length-weighted mean length of 1.0 mm or more).

Specifically, cellulosic fibers having a length-weighted mean length of 1.0 mm or more and 2.0 mm or less is mixed in slurry used in the composite fiber generating step in an amount of preferably not less than 60% by weight, more preferably not less than 80% by weight, further preferably 100% by weight, with respect to a total amount of the cellulosic fibers which are contained in the slurry. For example, LBKP having a length-weighted mean length of less than 1.0 mm and NBKP having a length-weighted mean length of 1.0 mm or more can be mixed at a ratio of LBKP/NBKP=40:60 to 0:100 or at a ratio of LBKP/NBKP=20:80 to 0:100.

Examples of cellulosic fibers which satisfy the above range of length-weighted mean length include publicly known needle bleached kraft pulp (NBKP), needle unbleached kraft pulp (NUKP), thermomechanical pulp (TMP), and the like.

In slurry that is used in the composite fiber generating step, a length-weighted mean length of cellulosic fibers (for convenience, referred to as "cellulosic fiber group B") to be mixed with the cellulosic fiber group A is not particularly limited. The length-weighted mean length of the cellulosic fiber group B can be, for example, less than 1.0 mm (preferably 0.6 mm or more and less than 1.0 mm), can be greater than 2.0 mm (preferably greater than 2.0 mm and 3.2 mm or less), or can be 1.0 mm or more and 2.0 mm or less. Examples of cellulosic fibers having such length-weighted mean lengths include publicly known leaf bleached kraft pulp (LBKP), mechanical pulp (GP), deinked pulp (DIP), unbeaten pulp, and the like.

An amount of cellulosic fibers contained in slurry for use in the composite fiber generating step (i.e., an amount of cellulosic fibers used to synthesize composite fibers) is preferably an amount with which 15% or more of the cellulosic fiber surface is covered with inorganic particles. For example, a weight ratio between cellulosic fibers and inorganic particles is preferably 5/95 to 95/5, and can be 10/90 to 90/10, 20/80 to 80/20, 30/70 to 70/30, 40/60 to 60/40.

(Inorganic Particles)

Inorganic particles to be synthesized (i.e., inorganic particles to be complexed with cellulosic fibers) in the composite fiber generating step can be selected as appropriate in accordance with a purpose. The inorganic particles are preferably insoluble or poorly soluble in water, because the inorganic particles may be synthesized in a water system in the composite fiber generating step, and the composite fibers may be used in a water system.

The inorganic particles are particles of an inorganic compound and can be, for example, a metal compound. The metal compound is so-called inorganic salt that is obtained by an ionic bond of positive ions of metal (e.g., $Na^+$, $Ca^{2+}$, $Mg^{2+}$, $Al^{3+}$, $Ba^{2+}$, or the like) and negative ions (e.g., $O^{2-}$, $OH^-$, $CO_3^{2-}$, $PO_4^{3-}$, $SO_4^{2-}$, $NO_3^-$, $Si_2O_3^{2-}$, $SiO_3^{2-}$, $Cl^-$, $F^-$, $S^{2-}$, or the like). Specific examples of the inorganic particles include a compound containing at least one metal selected from the group consisting of gold, silver, titanium, copper, platinum, iron, zinc, and aluminum. The inorganic particles can also be calcium carbonate (light calcium carbonate, heavy calcium carbonate), magnesium carbonate, barium carbonate, aluminum hydroxide, calcium hydroxide, barium sulfate, magnesium hydroxide, zinc hydroxide, calcium phosphate, zinc oxide, zinc stearate, titanium dioxide, silica composed of sodium silicate and mineral acid (white carbon, silica/calcium carbonate complex, silica/titanium dioxide complex), calcium sulfate, zeolite, hydrotalcite, and the like. As the calcium carbonate-silica complex, in addition to the complexes of calcium carbonate and/or light calcium carbonate and silica, amorphous silica such as white carbon can be used in combination. The above exemplified inorganic particles can be used alone or two or more types of those inorganic particles can be used in combination, provided that those inorganic particles do not disturb synthetic reactions in the solution containing fibers.

In a case where the inorganic particles in the composite fibers are hydrotalcite, it is more preferable that the ash of composite fibers of hydrotalcite and cellulosic fibers contains at least one of magnesium and zinc in an amount of not less than 10% by weight.

According to an embodiment of the present invention, the inorganic particles can contain at least one compound selected from the group consisting of calcium carbonate, magnesium carbonate, barium sulfate, and hydrotalcite.

(Composite Fibers)

According to the composite fibers composed of cellulosic fibers and inorganic particles, cellulosic fibers and inorganic particles do not merely mixedly exist but cellulosic fibers and inorganic particles are bonded together by hydrogen bonds or the like. Therefore, the inorganic particles are less likely to fall off even by the disaggregation process. A strength of the bond between cellulosic fibers and inorganic particles in the composite fibers can be evaluated, for example, by ash yield (% by mass). For example, in a case where the composite fibers are in a sheet form, the strength of the bond can be evaluated based on a numerical value of (ash content of sheet÷ash content of composite fibers before disintegration)×100. Specifically, after disintegration for 5 minutes with use of a standard disintegrator defined in JIS P 8220-1: 2012 while adjusting a solid concentration to 0.2% by weight by dispersing the composite fibers in water, an ash yield of a sheet obtained by using 150-mesh wires according to JIS P 8222: 1998 can be used for evaluation. In a preferable aspect, the ash yield is not less than 20% by mass and, in a more preferable aspect, the ash yield is not less than 50% by mass. That is, in a case where inorganic particles are made into composite fibers with use of cellulosic fibers and, for example, the composite fibers are in a sheet form, the inorganic particles are more likely to remain in the composite fibers and it is also possible to obtain the composite fibers in which the inorganic particles are not aggregated but are uniformly dispersed, unlike a case in which inorganic particles are simply mixed with cellulosic fibers.

According to an aspect of the present invention, it is preferable that 15% or more of a surface of each of the cellulosic fibers in the composite fibers is covered with inorganic particles. In a case where the cellulosic fiber surface is covered with the inorganic particles with such an area ratio, a characteristic attributable to the inorganic particles is greatly brought about, while a characteristic attributable to the cellulosic fiber surface becomes small. According to the composite fiber, a coverage (area ratio) of cellulosic fiber by inorganic particles is more preferably 25% or more, further preferably 40% or more. According to the method, it is possible to suitably produce composite fibers having a coverage of 60% or more, 80% or more. An upper limit of the coverage can be set as appropriate in accordance with the purpose of use and is, for example, 100%, 90%, 80%. In a preferable aspect of the composite fibers obtained by the composite fiber generating step, it is clear from a result of electron microscopy that inorganic particles are generated on outer surfaces of cellulosic fibers.

According to an aspect of the present invention, an ash content (%) of the composite fibers is preferably 30% or more and 90% or less, more preferably 40% or more and 80% or less. The ash content (%) of the composite fibers can be calculated as follows: that is, slurry (of 3 g on a solid content basis) of the composite fibers is subjected to suction filtration with use of filter paper; then a residue is dried in an oven (at 105° C. for 2 hours); then an organic component is further burned at 525° C.; and then the ash content is calculated based on a difference between weights measured before and after the burning. By forming such composite fibers into a sheet, it is possible to manufacture a composite fiber sheet having a high ash content.

Synthesis Example 1 of Composite Fibers:
Synthesis of Composite Fibers Composed of
Calcium Carbonate and Cellulosic Fibers Next, an example of a method for synthesizing composite fibers will be described based on an example in which composite fibers are synthesized from calcium carbonate and cellulosic fibers.

By synthesizing particles of calcium carbonate in a solution containing cellulosic fibers, it is possible to synthesize composite fibers from calcium carbonate and cellulosic fibers. The method for synthesizing calcium carbonate can be a known method. The calcium carbonate can be synthesized by, for example, a carbon dioxide process, a soluble salt reaction method, a lime-soda process, a soda method, or the like. In a preferable aspect, calcium carbonate is synthesized by the carbon dioxide process.

In general, in a case where calcium carbonate is produced by the carbon dioxide process, lime is used as a calcium source. Calcium carbonate is synthesized by (i) a slaking step of obtaining slaked lime $Ca(OH)_2$ by adding water to quick lime CaO and (ii) a carbonation step of obtaining calcium carbonate $CaCO_3$ by blowing a carbonic acid gas $CO_2$ into the slaked lime. In this case, it is possible to eliminate poorly soluble lime particles contained in a slaked lime suspension (prepared by adding water to quick lime) by passing the suspension through a screen. Alternatively, slaked lime can be directly employed as a calcium source. In a case where calcium carbonate is synthesized by the carbon dioxide process in an embodiment of the present invention, the carbonation reaction can be carried out in the presence of cavitation bubbles.

In general, as a reactor vessel (carbonator) for producing calcium carbonate by the carbon dioxide process, a gas blowing type carbonator and a mechanical stirring type carbonator are known. Among these, the mechanical stirring type carbonator is more preferable. The mechanical stirring type carbonator is provided with a stirrer that is placed inside a carbonator. A carbonic acid gas is introduced near the stirrer, and thus fine gas bubbles of the carbonic acid gas are generated. By this mechanism, it is easy to control a size of gas bubbles uniformly and finely. From this, efficiency of reaction between the slaked lime and the carbonic acid gas is improved (see "Cement—Sekkou—Sekkai Handbook (Handbook of cement, gypsum, and lime)", Gihodo Shuppan Co., Ltd., 1995, page 495). In the gas blowing type carbonator, a carbonic acid gas is blown into a carbonation reactor vessel containing a slaked lime suspension (milk of lime) so that the slaked lime is caused to react with the carbonic acid gas.

It is more preferable that calcium carbonate is synthesized in the presence of cavitation bubbles. This is because, even in a case where resistance of a reaction liquid increases due to high concentration of the reaction liquid or progression of carbonation reaction, the carbonic acid gas can be made finer by sufficiently stirring the carbonic acid gas. From this, it is possible to precisely control carbonation reaction, and it is accordingly possible to prevent energy loss. Residues of screened lime which are poorly soluble precipitate fast and tend to constantly remain at the bottom. However, by carrying out the synthesis in the presence of cavitation bubbles, it is possible to prevent a gas blowing port from being clogged.

Therefore, it is possible to efficiently progress the carbonation reaction, and thus uniform calcium carbonate fine particles can be produced. In particular, by using jet cavitation, it is possible to carry out sufficient stirring without a mechanical stirrer such as a blade. It is also possible to use a conventionally known reactor vessel. Of course, the above described gas blowing type carbonator or mechanical stirring type carbonator can be adequately used. Each of those vessels can be used in combination with jet cavitation using a nozzle or the like.

In a case where calcium carbonate is synthesized by the producing method of carbonic acid gas, a solid concentration of an aqueous suspension of slaked lime is preferably not less than 0.1% by weight, more preferably not less than 0.5% by weight, further preferably not less than 1% by weight, from the viewpoint of achieving better reaction efficiency and reducing a production cost. Moreover, the solid concentration is preferably not more than 40% by weight, more preferably not more than 30% by weight, further preferably not more than 20% by weight, or the like from the viewpoint of achieving better reaction efficiency by carrying out the reaction in a state of better fluidity. According to an aspect in which calcium carbonate is synthesized in the presence of cavitation bubbles, it is possible to more suitably mix the reaction liquid and the carbonic acid gas even with use of a suspension (slurry) having a higher solid concentration.

As the aqueous suspension containing slaked lime, it is possible to use an aqueous suspension that is generally used in synthesizing calcium carbonate. For example, such an aqueous suspension can be prepared by mixing slaked lime with water, slaking (digesting) quick lime (calcium oxide) with water, or the like. Conditions in slaking are not particularly limited and, for example, a concentration of CaO can be not less than 0.1% by weight, preferably not less than 1% by weight, and a temperature can be 20° C. to 100° C., preferably 30° C. to 100° C. An average residence time in a slaking reaction tank (i.e., slaker) is also not particularly limited and can be, for example, 5 minutes to 5 hours, preferably within 2 hours. Of course, the slaker can be of either a batch type or a continuous type. Note that the carbonation reactor vessel (i.e., carbonator) and the slaking reaction tank (i.e., slaker) can be provided separately, or one reaction tank can be used as the carbonation reactor vessel and the slaking reaction tank.

Synthesis Example 2 of Composite Fibers: Synthesis of Composite Fibers Composed of Barium Sulfate and Cellulosic Fibers Next, an example of a method for synthesizing composite fibers will be described based on an example in which composite fibers are synthesized from barium sulfate and cellulosic fibers.

Composite fibers composed of barium sulfate and cellulosic fibers can be produced by synthesizing barium sulfate particles in a solution containing cellulosic fibers. Examples of the method include a method in which an acid (such as sulfuric acid) and a base are caused to react with each other by neutralization; a method in which an inorganic salt is caused to react with an acid or a base; or a method in which inorganic salts are caused to react with each other. For example, barium sulfate can be obtained by causing barium hydroxide to react with sulfuric acid or aluminum sulfate. Alternatively, barium sulfate can be caused to precipitate by adding barium chloride to an aqueous solution that contains sulfate. Moreover, according to the method for producing barium sulfate described in this example, aluminum hydroxide is also generated. In a case where the composite fibers are synthesized from barium sulfate and fibers, it is possible to deposit barium sulfate in the presence of cavitation bubbles.

Synthesis Example 3 of Composite Fibers: Synthesis of Composite Fibers Composed of Hydrotalcite and Cellulosic Fibers Next, an example of a method for synthesizing composite fibers will be described based on an example in which composite fibers are synthesized from hydrotalcite and cellulosic fibers. By synthesizing hydrotalcite in a solution containing cellulosic fibers, it is possible to manufacture composite fibers from hydrotalcite and cellulosic fibers.

The method for synthesizing hydrotalcite can be a known method. For example, in a reactor vessel, fibers are immersed in (i) an aqueous carbonate solution containing carbonate ions that form an intermediate layer and (ii) an alkaline solution (such as sodium hydroxide), and then an acid solution (which is an aqueous metal salt solution containing bivalent metal ions and trivalent metal ions which form a base layer) is added. Then, coprecipitation reaction is carried out while controlling a temperature, pH, and the like, and thus hydrotalcite is synthesized. Alternatively, in a reactor vessel, fibers are immersed in an acid solution (which is an aqueous metal salt solution containing bivalent metal ions and trivalent metal ions which form a base layer), and then an aqueous carbonate solution containing carbonate ions which form an intermediate layer and an alkaline solution (such as sodium hydroxide) are dripped. Then, coprecipitation reaction is carried out while controlling a temperature, pH, and the like, and thus hydrotalcite can be synthesized. The reaction is generally carried out at normal atmospheric pressure. Alternatively, hydrotalcite can be obtained by hydrothermal reaction using an autoclave or the like (Japanese Patent Application Publication Tokukaisho No. 60-6619 (1985)).

As a source of bivalent metal ions that form the base layer, it is possible to use a chloride, sulfide, nitrate, or sulfate of magnesium, zinc, barium, calcium, iron, copper, silver, cobalt, nickel, or manganese. As a source of trivalent metal ions that form the base layer, it is possible to use a chloride, sulfide, nitrate, or sulfate of aluminum, iron, chromium, or gallium.

In a case where one of precursors of inorganic particles is alkaline as in this example, the fibers can be swollen by dispersing the fibers in advance in a solution of the alkaline precursor, so that the composite fibers composed of inorganic particles and fibers can be efficiently obtained. For example, the reaction can be started after swelling of the fibers is facilitated by stirring the mixture for 15 minutes or more after mixing, or the reaction can be started immediately after the mixing. In a case where a substance such as aluminum sulfate (aluminum sulfide, polyaluminum chloride, or the like) that is more likely to interact with cellulose is used as a part of the precursor of inorganic particles, a ratio at which the inorganic particles are fixed to the fibers can be improved by mixing the aluminum sulfate with the fibers in advance.

Synthesis Example 4 of Composite Fibers: Synthesis of Composite Fibers Composed of Magnesium Carbonate and Cellulosic Fibers Next, an example of a method for synthesizing composite fibers will be described based on an example in which composite fibers are synthesized from magnesium carbonate and cellulosic fibers.

By synthesizing magnesium carbonate in a solution containing cellulosic fibers, it is possible to manufacture composite fibers from magnesium carbonate and cellulosic fibers. The method for synthesizing magnesium carbonate can be a known method. Examples of the method include a method in which an acid (such as sulfuric acid) and a base are caused to react with each other by neutralization; a method in which an inorganic salt is caused to react with an acid or a base; or a method in which inorganic salts are caused to react with each other. For example, magnesium bicarbonate is synthesized from magnesium hydroxide and carbonic acid gas, and then basic magnesium carbonate can be synthesized from the magnesium bicarbonate via magnesium carbonate trihydrate. It is possible to obtain magnesium bicarbonate, magnesium carbonate trihydrate, basic magnesium carbonate, and the like by the method of synthesizing magnesium carbonate, and it is particularly preferable to synthesize the basic magnesium carbonate. This is because the basic magnesium carbonate has relatively high stability as compared with the other magnesium carbonates, and the basic magnesium carbonate is more likely to be fixed to fibers as compared with magnesium carbonate trihydrate which is a columnar (needle-like) crystal. Alternatively, in a case where chemical reaction is carried out in the presence of fibers until basic magnesium carbonate is obtained, it is possible to obtain composite fibers in which surfaces of fibers are coated with magnesium carbonate in a form of scales or the like.

It is preferable to synthesize magnesium carbonate in the presence of cavitation bubbles. In this case, cavitation bubbles do not need to exist in an entire synthesis route of magnesium carbonate, and cavitation bubbles only need to exist in at least one phase in the synthesis route.

For example, in a case where basic magnesium carbonate is to be manufactured, magnesium oxide MgO is used as a magnesium source, magnesium bicarbonate $Mg(HCO_3)_2$ is obtained by blowing carbonic acid gas $CO_2$ into magnesium hydroxide $Mg(OH)_2$ obtained from the magnesium oxide, and then basic magnesium carbonate is obtained from the magnesium bicarbonate via magnesium carbonate trihydrate $MgCO_3$—$3H_2O$. In a case where magnesium carbonate is synthesized in the presence of fibers, it is possible to synthesize basic magnesium carbonate on the fibers. It is preferable that cavitation bubbles exist in any synthesis phase of magnesium carbonate, and it is more preferable that cavitation bubbles exist in synthesizing magnesium carbonate. In a preferably aspect, cavitation bubbles can exist in a phase of synthesizing magnesium bicarbonate from magnesium hydroxide. In another aspect, cavitation bubbles can exist in a phase of synthesizing basic magnesium carbonate from magnesium bicarbonate or from magnesium carbonate trihydrate. In yet another aspect, cavitation bubbles can exist during aging of basic magnesium carbonate after synthesis of the basic magnesium carbonate.

In general, as a reactor vessel (carbonator) for manufacturing magnesium carbonate by the carbon dioxide process, the explanation of reactor vessel in "Synthesis Example 1 of composite fibers" applies. In a case where a mechanical stirring type carbonator is used, it is easy to control a size of gas bubbles uniformly and finely. From this, efficiency of reaction in synthesis carried out with use of carbonic acid gas is improved (see "Cement—Sekkou Sekkai Handbook (Handbook of cement, gypsum, and lime)", Gihodo Shuppan Co., Ltd., 1995, page 495).

It is more preferable that magnesium carbonate is synthesized in the presence of cavitation bubbles. This is because, even in a case where resistance of a reaction liquid increases due to high concentration of the reaction liquid or progression of carbonation reaction, the carbonic acid gas can be made finer by sufficiently stirring the carbonic acid gas. From this, it is possible to precisely control carbonation reaction, and it is accordingly possible to prevent energy loss. Residues of magnesium hydroxide which are poorly soluble precipitate fast and tend to constantly remain at the bottom. However, by carrying out the synthesis in the presence of cavitation bubbles, it is possible to prevent a gas blowing port from being clogged.

Therefore, it is possible to efficiently progress the carbonation reaction, and thus uniform magnesium carbonate fine particles can be produced. In particular, by using jet cavitation, it is possible to carry out sufficient stirring without a mechanical stirrer such as a blade. It is also possible to use a conventionally known reactor vessel. Of course, the above described gas blowing type carbonator or mechanical stirring type carbonator can be adequately used. Each of those vessels can be used in combination with jet cavitation using a nozzle or the like.

In a case where magnesium carbonate is synthesized, a solid concentration of an aqueous suspension of magnesium hydroxide is preferably not less than 0.1% by weight, more preferably not less than 0.5% by weight, further preferably not less than 1% by weight, from the viewpoint of achieving better reaction efficiency and reducing a production cost. Moreover, the solid concentration is preferably not more than 40% by weight, more preferably not more than 30% by weight, further preferably not more than 20% by weight, or the like from the viewpoint of achieving better reaction efficiency by carrying out the reaction in a state of better fluidity.

According to an aspect in which magnesium carbonate is synthesized in the presence of cavitation bubbles, it is possible to more suitably mix the reaction liquid and the carbonic acid gas even with use of a suspension (slurry) having a higher solid concentration.

As the aqueous suspension containing magnesium hydroxide, it is possible to use an aqueous suspension that is generally used. For example, such an aqueous suspension can be prepared by mixing magnesium hydroxide with water, adding magnesium oxide to water, or the like. Conditions in preparing slurry of magnesium hydroxide from magnesium oxide are not particularly limited. For example, a concentration of MgO can be not less than 0.1% by weight, preferably not less than 1% by weight, and a temperature can be 20° C. to 100° C., preferably 30° C. to 100° C. A reaction time is preferably, for example, 5 minutes to 5 hours, preferably within 2 hours. The device can be of either a batch type or a continuous type. Preparation of magnesium hydroxide slurry and carbonation reaction can be carried out either with separate devices or with one reaction tank.

(Other Conditions, Etc. Of Composite Fiber Generating Step)

According to an aspect of the present invention, water is used to prepare a suspension, and the like. Normal tap water, industrial water, groundwater, well water, or the like can be used as the water. Alternatively, it is possible to suitably use ion-exchanged water, distilled water, ultrapure water, industrial wastewater, or water obtained when a reaction liquid is separated or dehydrated.

The reaction liquid in the reaction tank can be circulated. In a case where the reaction liquid is circulated to facilitate stirring of the solution, it is possible to enhance efficiency of reaction and to easily obtain intended composite fibers.

According to an aspect of the present invention, various known assistants can be further added to slurry in the composite fiber generating step. For example, a chelating agent can be added. Specific examples of the chelating agent include polyhydroxy carboxylic acid such as citric acid, malic acid, and tartaric acid; dicarboxylic acid such as oxalic acid; saccharic acid such as gluconic acid; aminopolycarboxylic acid such as iminodiacetic acid and ethylenediaminetetraacetic acid and alkali metal salts thereof; alkali metal salts of polyphosphoric acid such as hexametaphosphoric acid and tripolyphosphoric acid; amino acid such as glutamic acid and aspartic acid, and alkali metal salts thereof; ketones such as acetylacetone, methyl acetoacetate, allyl acetoacetate; saccharides such as cane sugar; polyol such as sorbitol; and the like. Moreover, it is possible to add a surface treatment agent. Examples of the surface treatment agent include saturated fatty acid such as palmitic acid and stearic acid, unsaturated fatty acid such as oleic acid and linoleic acid, resin acid such as alicyclic carboxylic acid and abietic acid, and salts, esters, and ethers thereof, an alcohol-based activator, sorbitan fatty acid esters, an amide-based surfactant, an amine-based surfactant, polyoxyalkylene alkylethers, polyoxyethylene nonylphenyl ether, sodium alpha olefin sulfonate, long-chain alkyl amino acid, amine oxide, alkylamine, quaternary ammonium salt, aminocarboxylic acid, phosphonic acid, polyvalent carboxylic acid, condensed phosphoric acid, and the like. Moreover, a dispersing agent can be optionally used. Examples of the dispersing agent include sodium polyacrylate, sucrose fatty acid ester, glycerin fatty acid ester, acrylic acid-maleic acid copolymer ammonium salt, a methacrylic acid-naphthoxypolyethylene glycol acrylate copolymer, methacrylic acid-polyethyleneglycol monomethacrylate copolymer ammonium salt, polyethyleneglycol monoacrylate, and the like. These can be used solely, or two or more of these can be used in combination. A point in time of adding such an additive can be prior to or after the synthetic reaction. Such an additive can be added in an amount of preferably 0.001% to 20%, more preferably 0.1% to 10%, with respect to the inorganic particles.

According to an aspect of the present invention, the reaction condition in the composite fiber generating step is not particularly limited, and can be appropriately set in accordance with the purpose of use. For example, a temperature of the synthetic reaction can be 0° C. to 90° C., and is preferably 10° C. to 70° C. In regard to the reaction temperature, the reaction temperature of the reaction liquid can be controlled by a temperature adjusting device. In a case where a temperature is low, reaction efficiency decreases and a cost increases, while a temperature exceeding 90° C. tends to generate a large number of coarse inorganic particles.

According to an aspect of the present invention, the reactions can be batch reaction or consecutive reaction. Generally, it is preferable to carry out a batch reaction step in view of convenience of discharging the residue after reaction. A scale of the reaction is not particularly limited, and the reaction can be carried out on a scale of 100 L or less, or can be carried out on a scale of more than 100 L. A size of the reactor vessel can be, for example, approximately 10 L to 100 L, or can be approximately 100 L to 1000 L.

Further, the reaction can be controlled, for example, by monitoring pH of the reaction liquid. In a case of carbonation reaction of calcium carbonate, the reaction can be carried out until pH reaches, for example, below pH9, preferably below pH8, more preferably around pH7, depending on a pH profile of the reaction liquid.

The reaction can be controlled also by monitoring an electric conductivity of the reaction liquid. In the case of the carbonation reaction of calcium carbonate, for example, it is preferable to carry out carbonation reaction until the electric conductivity drops to 1 mS/cm or less.

Furthermore, the reaction can be controlled simply by adjusting a reaction time. Specifically, the reaction can be controlled by adjusting a residence time of a reactant in the reaction tank. Alternatively, according to an aspect of the present invention, the reaction can be controlled by stirring the reaction liquid in the reaction tank or by carrying out the reaction in multiple stages.

According to an aspect of the present invention, the composite fibers which are a reaction product are obtained as a suspension (slurry) in the composite fiber generating step. Therefore, optionally, the composite fibers can be stored in a storage tank, and the composite fibers can be subjected to processes such as concentration, dehydration, pulverization, classification, aging, and dispersion. These processes can be carried out by publicly known steps, and can be appropriately determined in view of a purpose of use, energy efficiency, and the like. For example, the concentration and dehydration process is carried out by use of a centrifugal hydroextractor, a sedimentation concentrator, or the like. Examples of the centrifugal hydroextractor include a decanter, a screw decanter, and the like. In a case where a filtering machine or a hydroextractor is used, a type of the filtering machine or the hydroextractor is not particularly limited, and a commonly used type can be used. For example, it is possible to use a pressurizing type hydroextractor such as a filter press, a drum filter, a belt press, or a tube press, or a vacuum drum hydroextractor such as an Oliver filter as appropriate. Examples of a pulverizing method include a ball mill, a sand grinder mill, an impact mill, a high-pressure homogenizer, a low-pressure homogenizer, a Dinomill, an ultrasonic mill, a Kanda grinder, an attritor, a stone mill, a vibrating mill, a cutter mill, a jet mill, a disintegrator, a beating machine, a short-screw extruder, a twin-screw extruder, an ultrasonic stirrer, a household juicer mixer, and the like. Examples of a classification method include a sieve such as a mesh, a slit or round hole screen of an outward type or an inward type, a vibrating screen, a heavy foreign matter cleaner, a light foreign matter cleaner, a reverse cleaner, a sieving tester, and the like. Examples of a dispersion method include a high speed disperser, a low speed kneader, and the like.

According to an aspect of the present invention, the composite fibers obtained in the composite fiber generating step can be reformed by a known method. For example, in a certain aspect, a surface of the composite can be hydrophobized to enhance miscibility with resin and the like. That is, an aspect of the present invention can further include a step of centrifuging the composite fibers, a step of reforming surfaces of the composite fibers, and/or the like after the composite fiber generating step and before the sheet generating step.

[2. Sheet Generating Step]

The sheet generating step is a step of continuously generating a sheet by supplying, to a continuous paper machine, composite-fiber-containing slurry that contains the composite fibers obtained by the composite fiber generating step.

A basis weight of a composite fiber sheet that is generated in the sheet generating step can be adjusted as appropriate in accordance with a purpose. A basis weight of the composite fiber sheet can be adjusted to, for example, 30 g/m$^2$ or more and 800 g/m$^2$ or less, preferably 50 g/m$^2$ or more and 600 g/m$^2$ or less.

(Continuous Paper Machine)

The continuous paper machine used in the sheet generating step is not particularly limited, and it is possible to select a publicly known paper machine (paper making machine). Examples of such a paper machine include a Fourdrinier machine, a cylinder paper machine, a combination of Fourdrinier machine and inclined former, a gap former, a hybrid former, a multilayer paper machine, a publicly known paper making machine in which paper making methods of those machines are combined, and the like. According to an embodiment of the present invention, a Fourdrinier machine can be suitably employed. According to another embodiment of the present invention, a cylinder paper machine can be suitably employed. The cylinder paper machine is suitable for producing a composite fiber sheet having a high basis weight. The cylinder paper machine is advantageously compact equipment, as compared with a Fourdrinier machine. In contrast, the Fourdrinier machine can advantageously make paper at a higher speed, as compared with the cylinder paper machine. A press linear pressure in a paper machine and a calendering linear pressure in a calendering process (later described) can be set within respective ranges that do not disturb productivity and performance of composite fiber sheet. It is possible to add starch, any of various polymers, a pigment, or a mixture thereof to a formed sheet by impregnation or application.

A paper making speed in the sheet generating step is not particularly limited. The paper making speed can be set as appropriate in accordance with a characteristic of used paper machine, a basis weight of sheet to be made, and the like. For example, in a case where a Fourdrinier machine is used, the paper making speed can be set to 1 m/min or more and 1500 m/min or less. For example, in a case where a cylinder paper machine is used, the paper making speed can be set to 10 m/min or more and 300 m/min or less.

(Composite-Fiber-Containing Slurry)

Composite-fiber-containing slurry (which is referred to as "paper stuff slurry" in the later-described Examples) used in the sheet generating step can contain either (i) only one type of composite fibers or (ii) two or more types of composite fibers which are mixed together.

It is possible to further add a substance, which is different from the composite fibers, to the composite-fiber-containing slurry to an extent that paper making is not disturbed. The following description will concretely discuss the substance which is different from the composite fibers.

(i) Non-Composite Fibers

The composite-fiber-containing slurry can contain non-composite fibers. The "non-composite fibers" herein are intended to be fibers which are not complexed with inorganic particles. The non-composite fibers are not particularly limited, and can be selected as appropriate in accordance with a purpose. As the non-composite fibers, for example, it is possible to employ various types of natural fibers, synthetic fibers, semi-synthetic fibers, inorganic fibers, as well as the above exemplified cellulosic fibers. Examples of the natural fibers include, for example, protein-based fibers such as wool fibers, silk fibers, and collagenous fibers; complex sugar chain fibers such as chitin/chitosan fibers and algin fibers; and the like. Examples of the synthetic fibers include polyester, polyamide, polyolefin, and acrylic fibers, and the like. Examples of the semi-synthetic fibers include rayon, lyocell, acetate, and the like. Examples of the inorganic fibers include glass fibers, carbon fibers, various metal fibers, and the like.

The composite fibers composed of synthetic fibers and cellulosic fibers can be used as non-composite fibers. For example, composite fibers composed of cellulosic fibers and polyester, polyamide, polyolefin, acrylic fibers, glass fibers, carbon fibers, various metal fibers, or the like can be used as the non-composite fibers.

Among those examples indicated above, the non-composite fibers preferably include wood pulp or a combination of wood pulp and non-wood pulp and/or synthetic fibers, more preferably include wood pulp alone. The non-composite fibers further preferably contain needle bleached kraft pulp because needle bleached kraft pulp has a long fiber length and is advantageous in improvement of strength.

The above exemplified fibers can be used alone or two or more types of those fibers can be used in combination. A type of the non-composite fibers can be either different from or identical with a type of fibers constituting the composite fibers.

The non-composite fibers preferably have a length-weighted mean length of 1.0 mm or more and 2.0 mm or less. In a case where the composite-fiber-containing slurry further contains non-composite fibers whose length-weighted mean length falls within the above range, it is possible to improve paper strength of the composite fiber sheet.

A weight ratio between composite fibers and non-composite fibers in the composite-fiber-containing slurry is preferably 10/90 to 100/0, and can be 20/80 to 90/10, 30/70 to 80/20. A mixed amount of the composite fibers in the composite-fiber-containing slurry is preferably larger in order to improve functionality of an obtained sheet. According to the method for manufacturing the inorganic particle composite fiber sheet in accordance with an aspect of the present invention, it is possible to manufacture the composite fiber sheet by a continuous paper machine without web break even in a case where the composite-fiber-containing slurry contains the composite fibers in an amount of not less than 20% by weight. Moreover, it is possible to manufacture a composite fiber sheet having a high ash content at a high yield.

(ii) Retention Aid

A retention aid can be added to the composite-fiber-containing slurry so as to facilitate fixation of a filler to fibers and to improve retention of a filler and fibers. As the retention aid, for example, it is possible to use a cationic, anionic, or amphoteric polyacrylamide-based substance. Alternatively, it is possible to apply so-called dual polymer that is a retention system in which at least one cationic polymer and/or at least one anionic polymer is used in combination with the polyacrylamide-based substance. It is possible to employ a multicomponent retention system in which the polyacrylamide based substance is used in combination with at least one type of (a) inorganic fine particles such as at least one of anionic bentonite; and (i) colloidal silica, polysilicic acid, (ii) microgel of polysilicic acid or polysilicate, and (iii) aluminum-modified product of (i) and (ii) and (b) organic fine particles which are called micropolymer in which acrylamide is cross-linked and polymerized and which has a particle size of 100 μm or less. In particular, in a case where a weight-average molecular weight (measured by a limiting viscosity method) of the polyacrylamide based substance that is used alone or in combination is 2 million daltons or more, it is possible to achieve good retention. The weight-average molecular weight of the acrylamide-based substance is preferably 5 million daltons or more, further preferably 10 million daltons or more and less than 30 million daltons.

In a case where the acrylamide-based substance having such a weight-average molecular weight is employed, it is possible to achieve extremely high retention. The polyacrylamide-based substance can be either in a form of emulsion or in a form of solution. A specific composition of the polyacrylamide-based substance is not particularly limited, provided that the polyacrylamide-based substance contains an acrylamide monomer unit as a structural unit. Examples of such a polyacrylamide-based substance include (i) a copolymer of quaternary ammonium salt of acrylic ester and acrylamide and (ii) ammonium salt obtained by copolymerizing acrylamide and acrylic ester and then quaternizing the obtained copolymer. A cationic charge density of the cationic polyacrylamide-based substance is not particularly limited.

The retention aid can be added in an amount of preferably 0.001% by weight to 0.1% by weight, more preferably 0.005% by weight to 0.05% by weight, with respect to a total weight of fibers in the composite-fiber-containing slurry.

(iii) Inorganic Particles which are not Complexed with Fibers

The composite-fiber-containing slurry can further contain inorganic particles which are not complexed with fibers. Such inorganic particles do not bind to cellulosic fibers by hydrogen bonds or the like but exist with fibers in a mixed manner, and are thus distinguished from the inorganic particles constituting the composite fibers. A type of the inorganic particles (hereinafter, referred to as "non-composite inorganic particles") which are not complexed with fibers can be either different from or identical with that of the inorganic particles which constitute the composite fibers. In a case where the non-composite inorganic particles are different in type from the inorganic particles which constitute the composite fibers, a function of the non-composite inorganic particles can be identical with, similar to, or different from that of the inorganic particles which constitute the composite fibers.

In a case where non-composite inorganic particles which are different in type and function from the inorganic particles which constitute the composite fibers are added, it is possible to manufacture a composite fiber sheet having functions of both types of the inorganic particles. In a case where (i) externally-added inorganic particles which are identical in type with the inorganic particles which constitute the composite fibers or (ii) non-composite inorganic particles, which are different in type from and identical in function with or similar in function to the inorganic particles constituting the composite fibers, are added, it is possible to further improve the function.

A type of non-composite inorganic particles can be selected as appropriate in accordance with a purpose. The foregoing descriptions of the inorganic particles which constitute the composite fibers are also applicable to the externally-added inorganic particles. It is possible to select particles which are generally called inorganic filler. Examples of the inorganic filler encompass, in addition to the foregoing inorganic particles, simple metal, white clay, bentonite, diatomaceous earth, clay (kaoline, fired kaolin, Delaminated Kaolin), talc, an inorganic filler that is obtained by recycling ash obtained from a deinking process, and an inorganic filler obtained by forming the complex with silica or calcium carbonate during the process of recycling ash obtained from the deinking process. Those can be used alone or two or more types of those can be used in combination.

In a case where the non-composite inorganic particles are added, a weight ratio between the fibers and the non-composite inorganic particles in the composite-fiber-containing slurry can be set as appropriate, and is preferably, for example, 99/1 to 70/30. The effect may be brought about with a small amount of the non-composite inorganic particles. Depending on the purpose of use, it is sometimes necessary to add a large amount of the non-composite inorganic particles. Good retention of non-composite inorganic particles can be achieved by setting an added amount of the non-composite inorganic particles to not more than 30% by weight with respect to fibers in the composite-fiber-containing slurry.

(iv) Organic Particles

In forming a sheet, it is possible to add organic particles. The organic particles are an organic compound in a particulate form. Examples of the organic particles include flame retardant organic materials (such as of phosphoric acid base or boron base) for enhancing flame retardancy, urea-formalin resin, polystyrene resin, phenol resin, hollow fine particles, acrylamide composite fibers, wood-derived substances (filaments, microfibrils, powdered kenaf), denatured insoluble starch for improving printability, ungelatinized starch, latex, and the like. Those can be used alone or two or more types of those can be used in combination.

In a case where the organic particles are added, a weight ratio between the fibers and the organic particles in the composite-fiber-containing slurry can be set as appropriate, and is preferably, for example, 99/1 to 70/30. Good retention of organic particles can be achieved by setting an added amount of the organic particles to not more than 30% by weight with respect to fibers in the composite-fiber-containing slurry.

(v) Other Additives

It is possible to add a wet paper strength agent and/or a dry paper strength agent (paper strength enhancer) to the composite-fiber-containing slurry. This makes it possible to improve strength of the composite fiber sheet. The paper strength agent can be, for example, resins such as urea formaldehyde resin, melamine formaldehyde resin, polyamide, polyamine, epichlorohydrin resin, vegetable gum, latex, polyethyleneimine, glyoxal, gum, mannogalactan polyethyleneimine, polyacrylamide resin, polyvinylamine, and polyvinyl alcohol; a composite polymer or a copolymer composed of two or more selected from those resins; starch and processed starch; carboxymethyl cellulose, guar gum, urea resin; and the like. An added amount of the paper strength agent is not particularly limited.

It is possible to add a high polymer or an inorganic substance in order to facilitate fixation of filler to fibers and to improve a yield of filler and fibers. For example, as a coagulant, it is possible to use a cationic polymer, a cation-rich zwitterionic polymer, a mixture of the cationic polymer and an anionic polymer or the zwitterionic polymer, or the like. The cationic polymer can be a modified polyethyleneimine containing polyethyleneimine and tertiary and/or quaternary ammonium group; polyalkyleneimine; a dicyandiamide polymer; polyamine; a polyamine/epichlohydrin polymer; a polymer of acrylamide and a dialkyl diallyl quaternary ammonium monomer, dialkylaminoalkyl acrylate, dialkylaminoalkyl methacrylate, dialkylaminoalkyl acrylamide, or dialkylaminoalkyl methacrylamide; a polymer of monoamines and epihalohydrin; a polymer having a polyvinylamine moiety and a vinylamine moiety; a mixture of these compounds; or the like. The cation-rich zwitterionic polymer can be obtained by copolymerizing an anionic group such as a carboxyl group or sulfone group with molecules of the cationic polymer.

Other examples of the additives include, in accordance with a purpose, a freeness improver, an internal sizing agent, a pH adjuster, an anti-foaming agent, a pitch control agent, a slime control agent, a bulking agent, inorganic particles (so-called filler) such as calcium carbonate, kaoline, talc, and silica, and the like. A used amount of each additive is not particularly limited.

(Multilayer Sheet)

In the sheet generating step, it is possible to manufacture, as the inorganic particle composite fiber sheet, a multilayer sheet in which two or more composite fiber sheets are stacked. In this case, a laminate can be obtained by stacking two or more composite fiber sheets. A method for manufacturing the multilayer sheet is not particularly limited. For example, it is possible to manufacture the multilayer sheet by combining a composite fiber sheet with a sheet containing no composite fibers with use of a publicly known combination of Fourdrinier machine and inclined former. From this, it is possible to improve paper strength of the composite fiber sheet, and this makes it possible to manufacture a composite fiber sheet with use of a continuous paper machine without web break.

It is possible to add, by impregnation or application, starch, any of various polymers, a pigment, or a mixture thereof to a composite fiber sheet formed in the sheet generating step.

[Effect]

According to the method for manufacturing the inorganic particle composite fiber sheet in accordance with an aspect of the present invention, it is possible to manufacture, without web break, an inorganic particle composite fiber sheet having a tear strength per basis weight in a machine direction of 3.0 mN/(g/m$^2$) or higher and 15.0 mN/(g/m$^2$) or lower by use of a continuous paper machine.

According to the method for manufacturing the inorganic particle composite fiber sheet in accordance with an aspect of the present invention, it is possible to manufacture, without web break, an inorganic particle composite fiber sheet at a paper stuff yield of 70% or more by use of a continuous paper machine.

According to the method for manufacturing the inorganic particle composite fiber sheet in accordance with an aspect of the present invention, it is possible to manufacture, without web break, an inorganic particle composite fiber sheet at an ash yield of 60% or more by use of a continuous paper machine.

Aspects of the present invention can also be expressed as follows:

The present invention encompasses but not limited to the following features:

(1) A method for manufacturing an inorganic particle composite fiber sheet, the method including: a composite fiber generating step of generating composite fibers composed of cellulosic fibers and inorganic particles by synthesizing the inorganic particles in slurry containing the cellulosic fibers; and a sheet generating step of continuously generating a sheet by supplying composite-fiber-containing slurry including the composite fibers to a continuous paper machine, the composite fiber generating step being carried out while using at least one of (i) slurry in which cellulosic fibers having a length of 1.2 mm to 2.0 mm are contained in an amount of 16% or more in terms of length-weighted fiber length distribution (%) and (ii) slurry in which cellulosic fibers having a length of 1.2 mm to 3.2 mm are contained in an amount of 30% or more in terms of length-weighted fiber length distribution (%).

(2) The method described in (1), in which a Canadian standard freeness of the cellulosic fibers which is measured based on JIS P 8121-2:2012 is 600 mL or lower.

(3) The method described in (1) or (2), in which a retention aid is added to the slurry before the sheet generating step.

(4) The method described in any one of (1) through (3), in which a basis weight of the sheet is 30 g/m$^2$ or more and 600 g/m$^2$ or less.

(5) The method described in any one of (1) through (4), in which the composite-fiber-containing slurry further contains fibers which (i) have a length-weighted mean length of 1.0 mm or more and 2.0 mm or less and (ii) are not complexed.

(6) The method described in any one of (1) through (5), in which the inorganic particles contain at least one compound selected from the group consisting of calcium carbonate, magnesium carbonate, barium sulfate, and hydrotalcite.

(7) The method described in any one of (1) through (6), in which the continuous paper machine is a Fourdrinier machine.

(8) The method described in any one of (1) through (6), in which the continuous paper machine is a cylinder paper machine.

(9) The method described in any one of (1) through (8), in which: in the sheet generating step, a multilayer sheet in which two or more sheets are stacked is generated, each of the two or more sheets constituting the multilayer sheet being the inorganic particle composite fiber sheet.

The present invention is not limited to the embodiments, but can be altered by a skilled person in the art within the scope of the claims. The present invention also encompasses, in its technical scope, any embodiment derived by combining technical means disclosed in differing embodiments.

EXAMPLES

Example 1

(1) Synthesis of Composite Fibers Composed of Barium Sulfate and Cellulosic Fibers As cellulosic fibers to be complexed, pulp fibers were used which contained leaf bleached kraft pulp and needle bleached kraft pulp with a weight ratio of 0:100 and in which a Canadian standard freeness (CSF) was adjusted to 290 mL with use of a single disk refiner (SDR) (see Table 1). Length-weighted fiber length distributions and a length-weighted mean length of cellulosic fibers complexed in Example 1 are shown in Table 1. Note that, in Examples, the "leaf bleached kraft pulp" is hereinafter abbreviated to "LBKP". Moreover, the "needle bleached kraft pulp" is abbreviated to "NBKP". LBKP and NBKP used were both manufactured by Nippon Paper Industries, Co. Ltd. Moreover, the "Canadian standard freeness" is abbreviated to "CSF".

<Measurement Method>

Canadian standard freeness (CSF): JIS P 8121-2:2012

Length-weighted mean length ($L_1$): Measured with Metso Fractionater (manufactured by Metso)

Length-weighted fiber length distribution (%): Measured with Metso Fractionater (manufactured by Metso)

With use of a device illustrated in FIG. 1, pulp slurry containing the pulp fibers (pulp fiber concentration: 1.8% by weight, pulp solid content: 36 kg) and barium hydroxide octahydrate (Nippon Chemical Industrial Co., Ltd.; 147 kg) were stirred and mixed in a container (machine chest having a capacity of 4 $m^3$) by use of an agitator, and then aluminum sulfide (Wako Pure Chemical Industries, Ltd.; 198 kg) was further mixed at 5.5 kg/min. After the mixing was completed, the stirring was continued for 60 minutes, and thus slurry of composite fibers in Example 1 was obtained. Note that, in Example 1, aluminum sulfide was used as a raw material for synthesizing barium sulfate. Thus, not only barium sulfate but also an aluminum compound such as aluminum hydroxide was synthesized. From this, in Example 1, composite fibers are synthesized from cellulosic fibers and barium sulfate and the aluminum compound such as aluminum hydroxide.

The composite fibers thus obtained were cleaned with ethanol, and then surfaces of the composite fibers were observed with an electron microscope. As a result of the observation, the fiber surface was covered with an inorganic substance by 15% or more, and thus the inorganic substance was fixed to the fibers by itself. Most of inorganic particles fixing to the fibers were plate-like particles, and particles which were small in size were observed as particles of amorphous shape. An average primary particle diameter of the inorganic particles estimated based on the observation result was 1 μm or less.

A weight ratio of fibers:inorganic particles in the composite fibers which were obtained was measured and was consequently 25:75 (ash content: 75%). Note that the weight ratio (ash content) was calculated as follows: that is, slurry (of 3 g on a solid content basis) of the composite fibers was subjected to suction filtration with use of filter paper; then a residue was dried in an oven (at 105° C. for 2 hours); then an organic component was further burned at 525° C.; and then the ash content was calculated based on a difference between weights measured before and after the burning.

(2) Manufacture of Composite Fiber Sheet

To slurry of the composite fibers (concentration: 1.2% by weight), 100 ppm (with respect to solid content) of a cationic retention aid (ND300, HYMO Co., Ltd) and 100 ppm (with respect to solid content) of an anionic retention aid (FA230, HYMO Co., Ltd) were added to prepare paper stuff slurry containing the composite fibers. Then, a composite fiber sheet (having a basis weight of 150 g/$m^2$) of Example 1 was produced from the paper stuff slurry using a Fourdrinier machine (manufactured by Suzuki Seikisho) at a rate of 10 m/min.

A result of evaluating productivity of continuous paper making is indicated in Table 3 below. The productivity of continuous paper making was evaluated as follows.

3: No web break was generated in the sheet during paper making, and the sheet could be continuously wound into a roll.

2: Web break was generated in the sheet during paper making.

1: Web break was generated in the sheet many times during paper making.

In Example 1, no web break was generated in the sheet during paper making, and the sheet could be continuously wound into a roll.

Example 2

Pulp fibers identical with those in Example 1 were used as cellulosic fibers to be complexed, and slurry of composite fibers composed of barium sulfate and cellulosic fibers was obtained with the same method as Example 1 (see Table 1). To the obtained slurry of composite fibers (concentration: 1.2% by weight), non-composite cellulosic fibers (specifically, non-composite NBKP) having $L_1$ of 1.0 mm or more and 2.0 mm or less were added such that a weight ratio between the composite fibers and the non-composite fibers became 83:17. To the slurry of composite fibers, 100 ppm (with respect to solid content) of a cationic retention aid (ND300, HYMO Co., Ltd) and 100 ppm (with respect to solid content) of an anionic retention aid (FA230, HYMO Co., Ltd) were added to prepare paper stuff slurry containing the composite fibers. Then, a composite fiber sheet (having a basis weight of 180 g/$m^2$) of Example 2 was produced from the paper stuff slurry with the same method as Example 1. In Example 2, no web break was generated in the sheet during paper making, and the sheet could be continuously wound into a roll (see Table 3).

Example 3

Pulp fibers identical with those in Example 1 were used as cellulosic fibers to be complexed, and paper stuff slurry containing composite fibers composed of barium sulfate and cellulosic fibers was prepared with the same method as Example 1 (see Table 1). Then, a composite fiber sheet (having a basis weight of 300 g/$m^2$) of Example 3 was produced from the paper stuff slurry using a 5-layer cylinder paper machine (manufactured by Toyama Zosen) at a rate of 20 m/min. In Example 3, no web break was generated in the sheet during paper making, and the sheet could be continuously wound into a roll (see Table 3).

Example 4

Pulp fibers identical with those in Example 1 were used as cellulosic fibers to be complexed, and paper stuff slurry containing composite fibers composed of barium sulfate and cellulosic fibers was prepared with the same method as Example 1 (see Table 1). A composite fiber sheet having a different basis weight (i.e., a basis weight of 520 g/$m^2$) of Example 4 was produced from the paper stuff slurry with the same method as Example 3. In Example 4, no web break was generated in the sheet during paper making, and the sheet could be continuously wound into a roll (see Table 3).

Example 5

(1) Synthesis of Composite Fibers Composed of Hydrotalcite and Cellulosic Fibers (1-1) Preparation of Alkaline Solution and Acid Solution A solution for synthesizing hydrotalcite (HT) was prepared. As an alkaline solution (solution A), a mixed aqueous solution was prepared which contained $Na_2CO_3$ (Wako Pure Chemical Industries, Ltd.) and NaOH (Wako Pure Chemical Industries, Ltd.) As an acid solution (solution B), a mixed aqueous solution was prepared which contained $ZnCl_2$ (Wako Pure Chemical Industries, Ltd.) and $AlCl_3$ (Wako Pure Chemical Industries, Ltd.)

Alkaline solution (solution A, $Na_2CO_3$ concentration: 0.05 M, NaOH concentration: 0.8 M)

Acid solution (solution B, Zn-base, $ZnCl_2$ concentration: 0.3 M, $AlCl_3$ concentration: 0.1 M)

(1-2) Synthesis of Composite Fibers

As cellulosic fibers to be complexed, pulp fibers (LBKP/NBKP=20:80; CSF=390 mL) shown in Table 1 were used. Length-weighted fiber length distributions and a length-weighted mean length of cellulosic fibers complexed in Example 5 are shown in Table 1.

The pulp fibers were added to the alkaline solution, and thus an aqueous suspension containing pulp fibers (pulp fiber concentration: 4.0% by weight, pH: 13) was prepared. The aqueous suspension (having a pulp solid content of 80 kg) was put in a reactor vessel (machine chest having a capacity of 4 $m^3$), and the acid solution (Zn-base) was dripped while the aqueous suspension was stirred, and thus hydrotalcite fine particles and fibers were synthesized into composite fibers ($Zn_6Al_2(OH)_{16}CO_3.4H_2O$). The device as illustrated in FIG. 1 was used, a reaction temperature was 60° C., and a drip rate was 1.5 kg/min, and the dripping was stopped when the pH of the reaction liquid reached approximately pH 6.5. After the dripping was finished, the reaction liquid was stirred for 60 minutes and washed with approximately 10 times as much water to remove salts.

As a result of electron microscopy, it was found that the fiber surface was covered with the inorganic substance by 15% or more, and an average primary particle diameter of the inorganic particles was 1 μm or less. A weight ratio of fibers:inorganic particles in the obtained composite fibers was 50:50 (ash content: 50%).

(2) Manufacture of Composite Fiber Sheet

Paper stuff slurry containing composite fibers was prepared by a method similar to that of Example 1, except that slurry (concentration: 1.2% by weight) of the composite fibers of Example 5 which were composed of hydrotalcite and cellulosic fibers were used. Then, a composite fiber sheet (having a basis weight of 150 g/$m^2$) of Example 5 was produced from the paper stuff slurry with the same method as Example 1. In Example 5, no web break was generated in the sheet during paper making, and the sheet could be continuously wound into a roll (see Table 3).

Example 6

(1) Synthesis of Composite Fibers Composed of Magnesium Carbonate and Cellulosic Fibers As cellulosic fibers to be complexed, pulp fibers (LBKP/NBKP=20:80; CSF=390 mL) shown in Table 1 were used. Length-weighted fiber length distributions and a length-weighted mean length of cellulosic fibers complexed in Example 6 are shown in Table 1.

Figure 2:
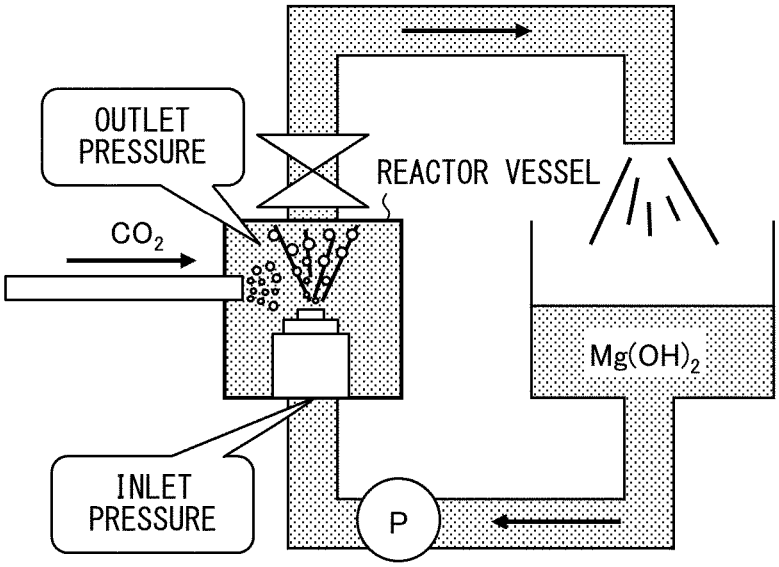
FIG. 2 is a schematic view schematically illustrating a configuration of a reactor which was used in Examples to synthesize composite fibers from magnesium carbonate and cellulosic fibers.

8.0 kg of magnesium hydroxide (Ube Material Industries, Ltd., UD653) and 8.0 kg of the pulp fibers were added to water, and thus an aqueous suspension (400 L) was prepared. As illustrated in FIG. 2, the aqueous suspension was put in a cavitation device (500 L capacity), and composite fibers of magnesium carbonate fine particles and fibers were synthesized by a carbon dioxide process by blowing carbonic acid gas into a reactor vessel while circulating a reaction solution. A reaction start temperature was approximately 40° C., the carbonic acid gas was supplied from a commercially available liquefied gas, and a blowing rate of the carbonic acid gas was 20 L/min. When pH of the reaction liquid became approximately 7.4, introduction of $CO_2$ was stopped (pH before reaction was 10.3), followed by generation of cavitation and circulation of slurry in the device for 30 minutes to obtain slurry of composite fibers of Example 6.

In synthesizing the composite fibers, cavitation bubbles were generated in the reactor vessel by circulating the reaction solution and injecting the reaction solution into the reactor vessel as shown in FIG. 2. Specifically, cavitation bubbles were generated by injecting the reaction solution at a high pressure through a nozzle (nozzle diameter: 1.5 mm), and a jet velocity was approximately 70 m/s, inlet pressure (upstream pressure) was 7 MPa, and outlet pressure (downstream pressure) was 0.3 MPa.

As a result of electron microscopy, it was found that the fiber surface was covered with the inorganic substance by 15% or more, and an average primary particle diameter of the inorganic particles was 1 μm or less. A weight ratio of fibers:inorganic particles in the obtained composite fibers was 50:50 (ash content: 50%).

(2) Manufacture of Composite Fiber Sheet

Paper stuff slurry containing composite fibers was prepared by a method similar to that of Example 1, except that slurry (concentration: 1.2% by weight) of the composite fibers of Example 6 which were composed of magnesium carbonate and cellulosic fibers were used. Then, a composite fiber sheet (having a basis weight of 300 g/$m^2$) of Example 6 was produced from the paper stuff slurry with the same method as Example 1. In Example 6, no web break was generated in the sheet during paper making, and the sheet could be continuously wound into a roll (see Table 3).

Example 7

(1) Synthesis of Composite Fibers Composed of Calcium Carbonate and Cellulosic Fibers As cellulosic fibers to be complexed, pulp fibers (LBKP/NBKP=20:80; CSF=390 mL) shown in Table 1 were used. Length-weighted fiber length distributions and a length-weighted mean length of cellulosic fibers complexed in Example 7 are shown in Table 1.

Figure 3:
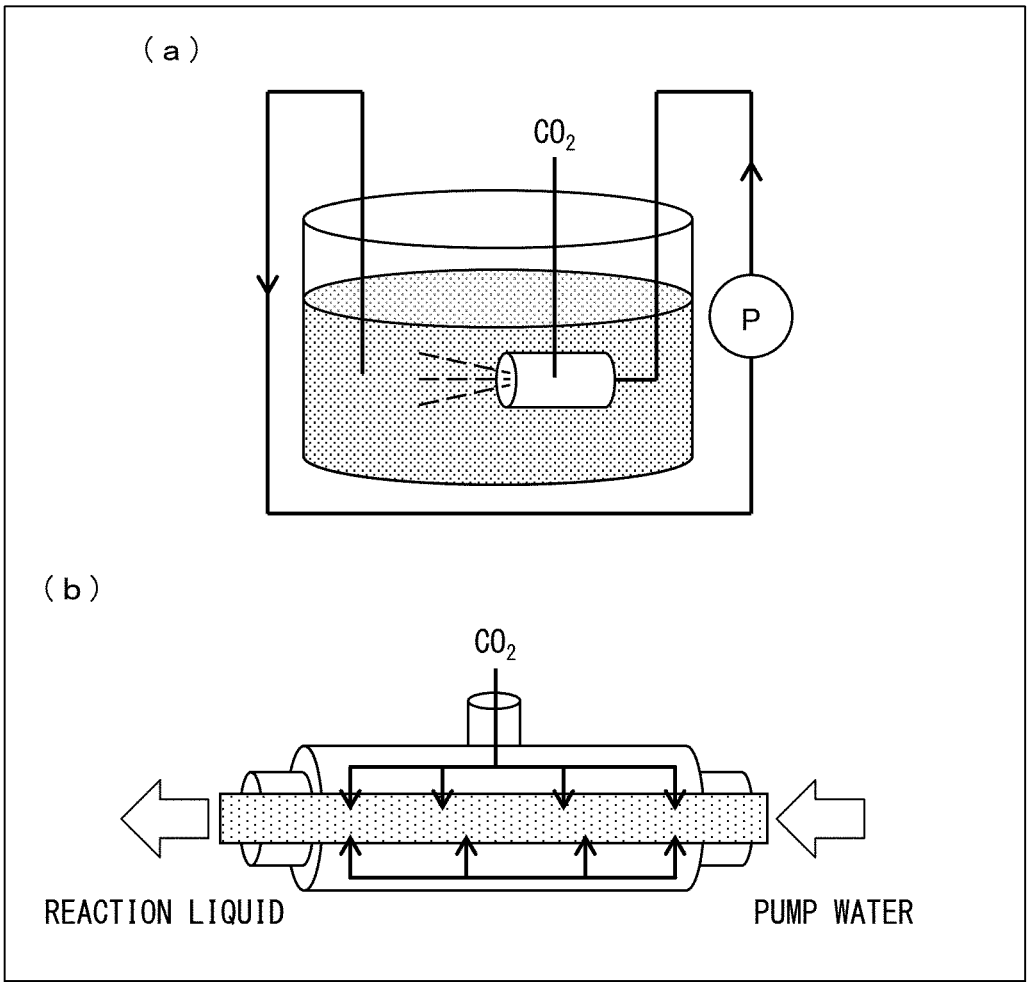
FIG. 3 is a schematic view schematically illustrating a configuration of a reactor which was used in Examples to synthesize composite fibers from calcium carbonate and cellulosic fibers.

Composite fibers were synthesized from calcium carbonate and fibers by a carbon dioxide process with use of a reactor as illustrated in (a) of FIG. 3. An aqueous suspension (1500 L) was prepared by adding 15 kg of calcium hydroxide (Okutama Kogyo Co., Ltd., TamaAce U) and 15 kg of the pulp fibers to water. A reaction liquid was circulated in the aqueous suspension at a pump flow rate of 80 L/min with use of an ultrafine bubble generator (UFB generator, YJ-9, Enviro Vision Co. Ltd., (b) of FIG. 3) (jet velocity from nozzle: 125 L/min·$cm^2$). A large amount of fine gas bubbles (having a diameter of 1 μm or less and an average particle diameter of 137 nm) containing carbonic acid gas were generated in the reaction liquid by blowing the carbonic acid gas through an air inlet of the ultrafine bubble generator, and thus calcium carbonate particles were synthesized on the pulp fibers. Reaction was carried out at a reaction temperature of 20° C. and at a carbonic acid gas blowing rate of 20 L/min, and the reaction was stopped when pH of the reaction liquid reached approximately 7 (note that pH before the reaction was approximately 13). Thus, slurry of composite fibers in Example 7 was obtained.

As a result of electron microscopy, it was found that the fiber surface was covered with the inorganic substance by 15% or more, and an average primary particle diameter of the inorganic particles was 1 μm or less. A weight ratio of fibers:inorganic particles in the obtained composite fibers was 50:50 (ash content: 50%).

(2) Manufacture of Composite Fiber Sheet

Paper stuff slurry containing composite fibers was prepared by a method similar to that of Example 1, except that slurry (concentration: 1.2% by weight) of the composite fibers of Example 7 which were composed of calcium carbonate and cellulosic fibers were used. Then, a composite fiber sheet (having a basis weight of 150 g/$m^2$) of Example 7 was produced from the paper stuff slurry with the same method as Example 1. In Example 7, no web break was generated in the sheet during paper making, and the sheet could be continuously wound into a roll (see Table 3).

TABLE 1

| | Composite fibers | | | | | | | | | |
|---|---|---|---|---|---|---|---|---|---|---|
| | Cellulosic fibers [weight ratio] | Length-weighted mean length [mm] | Length-weighted fiber length distribution [%] for 1.2 mm or more and 2.0 mm or less | Length-weighted fiber length distribution [%] for 1.2 mm or more and 3.2 mm or less | Inorganic particles | Fibers: Inorganic particles [weight ratio] | Contained amount of composite fibers [% by weight] | Added cellulosic fibers | Free-ness [ml] | Added inorganic particles |
| Example 1 | LBKP/NBKP = 0:100 | 1.4 | 22 | 39 | Barium sulfate | 25:75 | 100 | — | 290 | — |
| Example 2 | LBKP/NBKP = 0:100 | 1.4 | 22 | 39 | Barium sulfate | 25:75 | 83 | NBKP | 290 | — |
| Example 3 | LBKP/NBKP = 0:100 | 1.4 | 22 | 39 | Barium sulfate | 25:75 | 100 | — | 290 | — |
| Example 4 | LBKP/NBKP = 0:100 | 1.4 | 22 | 39 | Barium sulfate | 25:75 | 100 | — | 290 | — |
| Example 5 | LBKP/NBKP = 20:80 | 1.3 | 19 | 35 | Hydrotalcite | 50:50 | 100 | — | 390 | — |
| Example 6 | LBKP/NBKP = 20:80 | 1.3 | 19 | 35 | Magnesium carbonate | 50:50 | 100 | — | 390 | — |
| Example 7 | LBKP/NBKP = 20:80 | 1.3 | 19 | 35 | Calcium carbonate | 50:50 | 100 | — | 390 | — |

Comparative Example 1

(1) Synthesis of Composite Fibers Composed of Barium Sulfate and Cellulosic Fibers As cellulosic fibers to be complexed, pulp fibers (LBKP/NBKP=80:20, CSF=390 mL) shown in Table 2 were used. Length-weighted fiber length distributions and a length-weighted mean length of cellulosic fibers complexed in Comparative Example 1 are shown in Table 2. Slurry of composite fibers in Comparative Example 1 was obtained by a method similar to that of Example 1, except that the foregoing cellulosic fibers were complexed.

As a result of electron microscopy, it was found that the fiber surface was covered with the inorganic substance by 15% or more, and an average primary particle diameter of the inorganic particles was 1 μm or less. A weight ratio of fibers:inorganic particles in the obtained composite fibers was 25:75 (ash content: 75%).

(2) Manufacture of Composite Fiber Sheet

Paper stuff slurry containing composite fibers was prepared by a method similar to that of Example 1, except that slurry (concentration: 1.2% by weight) of the composite fibers of Comparative Example 1 which were composed of barium sulfate and cellulosic fibers were used. Then, a composite fiber sheet (having a basis weight of 150 g/m$^2$) of Comparative Example 1 was produced from the paper stuff slurry with the same method as Example 1. In Comparative Example 1, web break was generated in the sheet during paper making, but the sheet could be continuously wound into a roll (see Table 3).

Comparative Example 2

(1) Synthesis of Composite Fibers Composed of Barium Sulfate and Cellulosic Fibers As cellulosic fibers to be complexed, pulp fibers (LBKP/NBKP=50:50, CSF=290 mL) shown in Table 2 were used. Length-weighted fiber length distributions and a length-weighted mean length of cellulosic fibers complexed in Comparative Example 2 are shown in Table 2. Slurry of composite fibers in Comparative Example 2 was obtained by a method similar to that of Example 1, except that the foregoing cellulosic fibers were complexed.

As a result of electron microscopy, it was found that the fiber surface was covered with the inorganic substance by 15% or more, and an average primary particle diameter of the inorganic particles was 1 μm or less. A weight ratio of fibers:inorganic particles in the obtained composite fibers was 25:75 (ash content: 75%).

(2) Manufacture of Composite Fiber Sheet

Paper stuff slurry containing composite fibers was prepared by a method similar to that of Example 1, except that slurry (concentration: 1.2% by weight) of the composite fibers of Comparative Example 2 which were composed of barium sulfate and cellulosic fibers were used. Then, a composite fiber sheet (having a basis weight of 300 g/m$^2$) of Comparative Example 2 was produced from the paper stuff slurry with the same method as Example 3. In Comparative Example 2, web break was generated in the sheet many times during paper making, and the sheet could not be continuously wound into a roll (see Table 3).

Comparative Example 3

In Comparative Example 3, a sheet was manufactured by externally adding inorganic particles to cellulosic fibers. As cellulosic fibers, pulp fibers (LBKP/NBKP=20:80; CSF=390 mL) shown in Table 2 were used.

To slurry of the pulp fibers (concentration: 1.2% by weight), calcium carbonate (having an average particle diameter of 1.5 μm) was added in an amount of 1.2% by weight, and further 100 ppm (with respect to solid content) of a cationic retention aid (ND300, HYMO Co., Ltd) and 100 ppm (with respect to solid content) of an anionic retention aid (FA230, HYMO Co., Ltd) were added to prepare paper stuff slurry.

Then, a sheet (having a basis weight of 150 g/m$^2$) of Comparative Example 3 was produced from the paper stuff slurry with the same method as Example 1. In Comparative Example 3, web break was generated in the sheet many times during paper making, and the sheet could not be continuously wound into a roll (see Table 3).

Comparative Example 4

(1) Synthesis of Composite Fibers Composed of Calcium Carbonate and Cellulosic Fibers As cellulosic fibers, pulp fibers (LBKP/NBKP=80:20, CSF=100 mL) shown in Table 2 were used. Length-weighted fiber length distributions and a length-weighted mean length of cellulosic fibers complexed in Comparative Example 4 are shown in Table 2. Slurry of composite fibers in Comparative Example 4 was obtained by a method similar to that of Example 7, except that the foregoing cellulosic fibers were complexed.

As a result of electron microscopy, it was found that the fiber surface was covered with the inorganic substance by 15% or more, and an average primary particle diameter of the inorganic particles was 1 μm or less. A weight ratio of fibers:inorganic particles in the obtained composite fibers was 50:50 (ash content: 50%).

(2) Manufacture of Composite Fiber Sheet

Paper stuff slurry containing composite fibers was prepared by a method similar to that of Example 1, except that slurry (concentration: 1.2% by weight) of the composite fibers of Comparative Example 4 which were composed of calcium carbonate and cellulosic fibers were used. Then, a composite fiber sheet (having a basis weight of 70 g/m$^2$) of Comparative Example 4 was produced from the paper stuff slurry with the same method as Example 1. In Comparative Example 4, web break was generated in the sheet during paper making, but the sheet could be continuously wound into a roll (see Table 3).

Comparative Example 5

In Comparative Example 5, a sheet was manufactured by externally adding inorganic particles to cellulosic fibers, as with Comparative Example 3. As cellulosic fibers, pulp fibers (LBKP/NBKP=100:0, CSF=390 mL) shown in Table 2 were used.

To slurry of the pulp fibers (concentration: 1.2% by weight), calcium carbonate (having an average particle diameter of 1.5 μm) was added in an amount of 0.2% by weight, and further 100 ppm (with respect to solid content) of a cationic retention aid (ND300, HYMO Co., Ltd) and 100 ppm (with respect to solid content) of an anionic retention aid (FA230, HYMO Co., Ltd) were added to prepare paper stuff slurry.

Then, a sheet (having a basis weight of 150 g/m$^2$) of Comparative Example 5 was produced from the paper stuff slurry with the same method as Example 1. In Comparative Example 5, no web break was generated in the sheet during paper making, and the sheet could be continuously wound into a roll (see Table 3).

Comparative Example 6

(1) Synthesis of Composite Fibers Composed of Calcium Carbonate and Cellulosic Fibers As cellulosic fibers, pulp fibers (LBKP/NBKP=100:0, CSF=390 mL) shown in Table 2 were used. Length-weighted fiber length distributions and a length-weighted mean length of cellulosic fibers complexed in Comparative Example 6 are shown in Table 2. Slurry of composite fibers in Comparative Example 6 was obtained by a method similar to that of Example 7, except that the foregoing cellulosic fibers were complexed.

As a result of electron microscopy, it was found that the fiber surface was covered with the inorganic substance by 15% or more, and an average primary particle diameter of the inorganic particles was 1 μm or less. A weight ratio of fibers:inorganic particles in the obtained composite fibers was 20:80 (ash content: 80%).

(2) Manufacture of Composite Fiber Sheet

Paper stuff slurry containing composite fibers was prepared by a method similar to that of Example 1, except that slurry (concentration: 1.2% by weight) of the composite fibers of Comparative Example 6 which were composed of calcium carbonate and cellulosic fibers were used. Then, a composite fiber sheet (having a basis weight of 70 g/m$^2$) of Comparative Example 6 was produced from the paper stuff slurry with the same method as Example 1. In Comparative Example 6, web break was generated in the sheet many times during paper making, and the sheet could not be continuously wound into a roll (see Table 3).

TABLE 2

| | Composite fibers | | | | | | | | | |
|---|---|---|---|---|---|---|---|---|---|---|
| | Cellulosic fibers [weight ratio] | Length-weighted mean length [mm] | Length-weighted fiber length distribution [%] for 1.2 mm or more and 2.0 mm or less | Length-weighted fiber length distribution [%] for 1.2 mm or more and 3.2 mm or less | Inorganic particles | Fibers: Inorganic particles [weight ratio] | Contained amount of composite fibers [% by weight] | Added cellulosic fibers | Free-ness [ml] | Added inorganic particles |
| Com. Example 1 | LBKP/NBKP = 80:20 | 0.9 | 9 | 15 | Barium sulfate | 25:75 | 100 | — | 390 | — |
| Com. Example 2 | LBKP/NBKP = 50:50 | 1.1 | 15 | 29 | Barium sulfate | 25:75 | 100 | — | 290 | — |
| Com. Example 3 | — | — | — | — | — | — | 0 | LBKP/NBKP = 20:80 | 390 | Calcium carbonate |
| Com. Example 4 | LBKP/NBKP = 80:20 | 0.8 | 9 | 15 | Calcium carbonate | 50:50 | 100 | — | 100 | — |

TABLE 2-continued

| | Composite fibers | | | | | | | | | |
|---|---|---|---|---|---|---|---|---|---|---|
| | Cellulosic fibers [weight ratio] | Length-weighted mean length [mm] | Length-weighted fiber length distribution [%] for 1.2 mm or more and 2.0 mm or less | Length-weighted fiber length distribution [%] for 1.2 mm or more and 3.2 mm or less | Inorganic particles | Fibers: Inorganic particles [weight ratio] | Contained amount of composite fibers [% by weight] | Added cellulosic fibers | Free-ness [ml] | Added inorganic particles |
| Com. Example 5 | — | — | — | — | — | — | 0 | LBKP/NBKP = 100:0 | 390 | Calcium carbonate |
| Com. Example 6 | LBKP/NBKP = 100:0 | 0.7 | 6 | 11 | Calcium carbonate | 20:80 | 100 | — | 390 | — |

<<Evaluation of Composite Fiber Sheet>>

Characteristics of the sheets obtained in respective Examples and Comparative Examples were measured as follows.

<Measurement Method>

Paper stuff yield (% by mass): The raw material (inlet) and white water were taken out during paper making, and a paper stuff yield was calculated by the following formula based on a solid concentration.

Paper stuff yield(% by mass)=(raw material concentration−white water concentration)/raw material concentration×100

Ash yield (% by mass): The raw material (inlet) and white water were taken out during paper making, and an ash yield was calculated by the following formula based on an ash content.

Ash yield(% by mass)=(raw material concentration×ash content of raw material−white water concentration×ash content of white water)/raw material concentration×ash content of raw material×100

Basis weight: JIS P 8124:1998

Ash content: Obtained from an ash content of a simple inorganic substance based on JIS P 8251:2003.

BET specific surface area: Approximately 0.2 g of each sheet sample was degassed for 2 hours in a nitrogen atmosphere at 105° C., and then a BET specific surface area was measured with an automatic specific surface area measuring device (Gemini VII manufactured by Micromeritics).

Tear strength per basis weight (machine direction): JIS P 8116:2000

Table 3 below shows the results.

TABLE 3

| | Paper machine | Paper stuff yield [%] | Ash yield [%] | Operating rate | Basis weight [g/m$^2$] | Ash content [%] | BET specific surface area [m$^2$/g] | Specific tear strength in MD [mN/(g/m$^2$)] |
|---|---|---|---|---|---|---|---|---|
| Example 1 | Fourdrinier | 97 | 90 | 3 | 150 | 64 | 36 | 5.0 |
| Example 2 | Fourdrinier | 98 | 94 | 3 | 180 | 60 | 33 | 6.1 |
| Example 3 | Cylinder (5-layer) | 72 | 64 | 3 | 300 | 55 | 35 | 7.5 |
| Example 4 | Cylinder (5-layer) | 70 | 62 | 3 | 520 | 45 | 33 | 9.8 |
| Example 5 | Fourdrinier | 90 | 97 | 3 | 150 | 46 | 18 | 7.6 |
| Example 6 | Fourdrinier | 91 | 85 | 3 | 300 | 47 | 22 | 7.4 |
| Example 7 | Fourdrinier | 77 | 66 | 3 | 150 | 52 | 8 | 7.2 |
| Com. Example 1 | Fourdrinier | 98 | 90 | 2 (web break) | 150 | 64 | 36 | 2.0 |
| Com. Example 2 | Cylinder (5-layer) | 53 | 39 | 2 (lot of web break) | 300 | 55 | 35 | 2.6 |
| Com. Example 3 | Fourdrinier | 82 | 36 | 1 (lot of web break) | 150 | 26 | 6 | 0.8 |
| Com. Example 4 | Fourdrinier | 82 | 66 | 2 (web break) | 70 | 53 | 7 | 2.6 |
| Com. Example 5 | Fourdrinier | 74 | 55 | 3 | 150 | 15 | 4 | 9.4 |

TABLE 3-continued

| | Paper machine | Paper stuff yield [%] | Ash yield [%] | Operating rate | Basis weight [g/m$^2$] | Ash content [%] | BET specific surface area [m$^2$/g] | Specific tear strength in MD [mN/(g/m$^2$)] |
|---|---|---|---|---|---|---|---|---|
| Com. Example 6 | Fourdrinier | 51 | 44 | 1 (lot of web break) | 70 | 69 | 8 | 0.9 |

As shown in Table 3, in Examples 1 through 7, composite fibers were employed as raw materials which (i) contained cellulosic fibers having a length of 1.2 mm to 2.0 mm in an amount of 16% or more in terms of length-weighted fiber length distribution (%) or (ii) contained cellulosic fibers having a length of 1.2 mm to 3.2 mm in an amount of 30% or more in terms of length-weighted fiber length distribution (%). From this, it was possible to manufacture sheets having a BET specific surface area of 8 m$^2$/g or more with use of a continuous paper machine. Moreover, in Examples 1 through 7, the yields were extremely high, specifically, the paper stuff yield was 70% or more, and the ash yield was 60% or more.

In particular, the composite fiber sheet of Example 2, to which the non-composite NBKP had been added later, achieved improvement in tear strength per basis weight in the machine direction, as compared with the composite fiber sheet which did not contain non-composite NBKP.

In contrast, a composite fiber sheet could not be manufactured by use of a continuous paper machine from composite fiber slurry prepared from (i) slurry in which cellulosic fibers having a length of 1.2 mm to 2.0 mm were contained in an amount of less than 16% in terms of length-weighted fiber length distribution (%) or (ii) slurry in which cellulosic fibers having a length of 1.2 mm to 3.2 mm were contained in an amount of less than 30% in terms of length-weighted fiber length distribution (%) (Comparative Examples 1, 2, 4, and 6). In Comparative Example 3 in which the paper stuff slurry was used in which inorganic particles had been externally added to the cellulosic fibers, a composite fiber sheet could not be manufactured by use of the continuous paper machine. In Comparative Example 5 in which the paper stuff slurry was used in which inorganic particles had been externally added to the cellulosic fibers, the yields (i.e., the paper stuff yield and the ash yield) were low.

INDUSTRIAL APPLICABILITY

An aspect of the present invention is suitably applicable to the paper manufacturing field in which continuous paper making is carried out.

The invention claimed is:

1. A method for manufacturing an inorganic particle composite fiber sheet, said method comprising:

a composite fiber generating step of generating composite fibers composed of cellulosic fibers and inorganic particles by synthesizing the inorganic particles in slurry containing the cellulosic fibers; and a sheet generating step of continuously generating a sheet by supplying composite-fiber containing slurry including the composite fibers to a continuous paper machine, the composite fiber generating step being carried out while using slurry in which (i) cellulosic fibers having a length of 1.2 mm to 2.0 mm are contained in an amount of 16% or more in terms of length-weighted fiber length distribution (%) and (ii) cellulosic fibers having a length of 1.2 mm to 3.2 mm are contained in an amount of 30% or more in terms of length-weighted fiber length distribution (%), wherein the method further comprises, before the composite fiber generating step, a slurry preparing step of preparing the slurry by beating the cellulosic fibers and mixing, with a raw material for synthesizing the inorganic particles, the cellulosic fibers which have been beaten.

2. The method as set forth in claim 1, wherein a Canadian standard freeness of the cellulosic fibers which is measured based on JIS P 8121-2:2012 is 600 mL or lower.

3. The method as set forth in claim 1, wherein a retention aid is added to the slurry before the sheet generating step.

4. The method as set forth in claim 1, wherein a basis weight of the sheet is 30 g/m·sup·2 or more and 600 g/m$^2$ or less.

5. The method as set forth in claim 1, wherein the composite-fiber-containing slurry further contains fibers which (i) have a length-weighted mean length of 1.0 mm or more and 2.0 mm or less and (ii) are not complexed.

6. The method as set forth in claim 1, wherein the inorganic particles contain at least one compound selected from the group consisting of calcium carbonate, magnesium carbonate, barium sulfate, and hydrotalcite.

7. The method as set forth in claim 1, wherein the continuous paper machine is a Fourdrinier machine.

8. The method as set forth in claim 1, wherein the continuous paper machine is a cylinder paper machine.

9. The method as set forth in claim 1, wherein:

in the sheet generating step, a multilayer sheet in which two or more sheets are stacked is generated, each of the two or more sheets constituting the multilayer sheet being the inorganic particle composite fiber sheet.

10. The method as set forth in claim 1, further comprising:

a step of measuring a length-weighted fiber length distribution of the cellulosic fibers after the slurry preparing step and before the composite fiber generating step.

* * * * *